US011802404B2

(12) United States Patent
Pilz et al.

(10) Patent No.: US 11,802,404 B2
(45) Date of Patent: Oct. 31, 2023

(54) FIRE-RATED WALL AND CEILING SYSTEM

(71) Applicant: CEMCO, LLC, City of Industry, CA (US)

(72) Inventors: Donald Anthony Pilz, Livermore, CA (US); Raymond Edward Poliquin, City of Industry, CA (US); Fernando Hernandez Sesma, City of Industry, CA (US)

(73) Assignee: CEMCO, LLC, City of Industry, CA (US)

( * ) Notice: Subject to any disclaimer, the term of this patent is extended or adjusted under 35 U.S.C. 154(b) by 0 days.

(21) Appl. No.: 17/935,291

(22) Filed: Sep. 26, 2022

(65) Prior Publication Data

US 2023/0114420 A1 Apr. 13, 2023

Related U.S. Application Data

(63) Continuation of application No. 16/845,535, filed on Apr. 10, 2020, now Pat. No. 11,466,449, which is a (Continued)

(51) Int. Cl.
*E04B 1/94* (2006.01)
*E04B 2/74* (2006.01)

(Continued)

(52) U.S. Cl.
CPC ..... *E04B 1/944* (2013.01); *E04B 1/24* (2013.01); *E04B 1/947* (2013.01); *E04B 1/948* (2013.01);

(Continued)

(58) Field of Classification Search
CPC . E04B 1/944; E04B 1/24; E04B 1/947; E04B 1/948; E04B 2/58; E04B 2/60;

(Continued)

(56) References Cited

U.S. PATENT DOCUMENTS 661,832 A 11/1900 Wilkinson
716,628 A * 12/1902 Dickey ..... E04B 5/40 52/332

(Continued)

FOREIGN PATENT DOCUMENTS

CA 2234347 10/1999
CA 2711659 2/2012

(Continued)

OTHER PUBLICATIONS

U.S. Appl. No. 17/303,173, filed May 21, 2021, Pilz et al.

(Continued)

*Primary Examiner* — Brent W Herring
(74) *Attorney, Agent, or Firm* — Knobbe Martens Olson & Bear LLP

(57) ABSTRACT

The present application is directed toward fire-rated wall construction components and wall systems for use in building construction. Embodiments can include tracks for holding studs which incorporate various geometries capable of receiving fire-retardant material, flat straps for use between tracks and fluted wall components, fire sponges for use in fluted wall components, and tracks with protruding grooves or other structures which prevent unwanted air movement between a wallboard component and the track.

10 Claims, 14 Drawing Sheets

Related U.S. Application Data continuation of application No. 16/253,653, filed on Jan. 22, 2019, now Pat. No. 10,619,347, which is a continuation of application No. 15/986,280, filed on May 22, 2018, now Pat. No. 10,214,901, which is a continuation of application No. 15/680,072, filed on Aug. 17, 2017, now Pat. No. 10,011,983, which is a continuation of application No. 15/337,972, filed on Oct. 28, 2016, now Pat. No. 9,739,052, which is a continuation of application No. 14/844,966, filed on Sep. 3, 2015, now Pat. No. 9,481,998, which is a continuation of application No. 14/284,297, filed on May 21, 2014, now Pat. No. 9,127,454, which is a continuation of application No. 13/691,595, filed on Nov. 30, 2012, now Pat. No. 9,637,914, which is a continuation of application No. 13/217,145, filed on Aug. 24, 2011, now Pat. No. 8,322,094, which is a continuation of application No. 12/196,115, filed on Aug. 21, 2008, now Pat. No. 8,087,205, which is a continuation-in-part of application No. 12/013,361, filed on Jan. 11, 2008, now Pat. No. 7,617,643.

(60) Provisional application No. 60/957,434, filed on Aug. 22, 2007.

(51) Int. Cl.

| | |
|---|---|
| ***E04B 2/58*** | (2006.01) |
| ***E04B 2/60*** | (2006.01) |
| ***E04C 3/32*** | (2006.01) |
| ***E04B 1/24*** | (2006.01) |
| ***E04B 2/82*** | (2006.01) |
| ***E04B 2/76*** | (2006.01) |
| ***E04C 3/04*** | (2006.01) |
| ***E04C 3/29*** | (2006.01) |
| ***E04B 9/00*** | (2006.01) |

(52) U.S. Cl.

CPC ..... *E04B 2/58* (2013.01); *E04B 2/60* (2013.01); *E04B 2/7411* (2013.01); *E04B 2/76* (2013.01); *E04B 2/82* (2013.01); *E04B 9/008* (2013.01); *E04C 3/04* (2013.01); *E04C 3/29* (2013.01); *E04C 3/32* (2013.01); *E04B 1/94* (2013.01); *E04B 2103/06* (2013.01); *E04C 2003/0404* (2013.01)

(58) Field of Classification Search

CPC . E04B 2/7411; E04B 2/76; E04B 2/82; E04B 1/94; E04B 2103/06; E04C 3/04; E04C 3/32; E04C 2003/0404

USPC ..... 52/317, 396.01

See application file for complete search history.

(56) References Cited

U.S. PATENT DOCUMENTS 965,595 A 7/1910 Nicholson
1,130,722 A 3/1915 Fletcher
1,563,651 A 12/1925 Pomerantz
1,719,728 A 7/1929 Saunders
2,105,771 A 1/1938 Holdsworth
2,114,386 A 4/1938 Killion
2,218,426 A 10/1940 Hulbert, Jr.
2,556,878 A 6/1951 Kohlhaas
2,664,739 A 1/1954 Marcy
2,683,927 A 7/1954 Maronek
2,688,927 A 9/1954 Nuebling
2,733,786 A 2/1956 Drake
2,994,114 A 8/1961 Black
3,041,682 A 7/1962 Alderfer et al.
3,129,792 A 4/1964 Gwynne
3,153,467 A 10/1964 Nelsson et al.
3,271,920 A 9/1966 Downing, Jr.
3,309,826 A 3/1967 Zinn
3,324,615 A 6/1967 Zinn
3,346,909 A 10/1967 Blackburn
3,355,852 A 12/1967 Lally
3,397,495 A 8/1968 Thompson
3,460,302 A 8/1969 Cooper
3,481,090 A 12/1969 Lizee
3,495,417 A 2/1970 Ratliff
3,537,219 A 11/1970 Navarre
3,562,985 A 2/1971 Nicosia
3,566,559 A 3/1971 Dickson
3,604,167 A 9/1971 Hays
3,609,933 A 10/1971 Jahn et al.
3,648,419 A 3/1972 Marks
3,668,041 A 6/1972 Lonning
3,683,569 A 8/1972 Holm
3,696,569 A 10/1972 Didry
3,707,819 A 1/1973 Calhoun et al.
3,713,263 A 1/1973 Mullen
3,730,477 A 5/1973 Wavrunek
3,744,199 A 7/1973 Navarre
3,757,480 A 9/1973 Young
3,786,604 A 1/1974 Kramer
3,837,126 A 9/1974 Voiturier et al.
3,839,839 A 10/1974 Tillisch et al.
3,866,370 A 2/1975 Guarino et al.
3,908,328 A 9/1975 Nelsson
3,921,346 A 11/1975 Sauer et al.
3,922,830 A 12/1975 Guarino et al.
3,934,066 A 1/1976 Murch
3,935,681 A 2/1976 Voiturier et al.
3,955,330 A 5/1976 Wendt
3,964,214 A 6/1976 Wendt
3,974,607 A 8/1976 Balinski
3,976,825 A 8/1976 Anderberg
3,998,027 A 12/1976 Wendt et al.
4,011,704 A 3/1977 O'Konski
4,103,463 A 8/1978 Dixon
4,122,203 A 10/1978 Stahl
4,130,972 A 12/1978 Varlonga
4,139,664 A 2/1979 Wenrick
4,144,335 A 3/1979 Edwards
4,144,385 A 3/1979 Downing
4,152,878 A 5/1979 Balinski
4,164,107 A 8/1979 Kraemling et al.
4,178,728 A 12/1979 Ortmanns et al.
4,197,687 A * 4/1980 Benoit ..... E04B 5/06 52/262
4,203,264 A 5/1980 Kiefer et al.
4,205,498 A 6/1980 Unayama
4,217,731 A 8/1980 Saino
4,269,890 A * 5/1981 Breitling ..... B29C 44/184 264/45.2
4,276,332 A 6/1981 Castle
4,281,494 A 8/1981 Weinar
4,283,892 A 8/1981 Brown
4,295,304 A 10/1981 Kim
4,318,253 A 3/1982 Wedel
4,324,835 A 4/1982 Keen
4,329,820 A 5/1982 Wendt
4,356,672 A 11/1982 Beckman et al.
4,361,994 A 12/1982 Carver
4,424,653 A 1/1984 Heinen
4,433,732 A 2/1984 Licht et al.
4,434,592 A 3/1984 Reneault et al.
4,437,274 A 3/1984 Slocum et al.
4,454,690 A 6/1984 Dixon
4,461,120 A 7/1984 Hemmerling
4,467,578 A 8/1984 Weinar
4,480,419 A 11/1984 Crites
4,495,238 A 1/1985 Adiletta
4,497,150 A 2/1985 Wendt et al.
4,507,901 A 4/1985 Carroll
4,509,559 A 4/1985 Cheetham et al.
4,517,782 A 5/1985 Shamszadeh
4,575,979 A 3/1986 Mariani

(56) References Cited

U.S. PATENT DOCUMENTS 4,578,913 A 4/1986 Eich
4,598,516 A 7/1986 Groshong
4,622,794 A 11/1986 Geortner
4,632,865 A 12/1986 Tzur
4,649,089 A 3/1987 Thwaites
4,672,785 A 6/1987 Salvo
4,709,517 A 12/1987 Mitchell et al.
4,711,183 A 12/1987 Handler et al.
4,723,385 A 2/1988 Kallstrom
4,756,945 A 7/1988 Gibb
4,761,927 A 8/1988 O'Keeffe et al.
4,787,767 A 11/1988 Wendt
4,805,364 A 2/1989 Smolik
4,810,986 A 3/1989 Leopold
4,822,659 A 4/1989 Anderson et al.
4,825,610 A 5/1989 Gasteiger
4,845,904 A 7/1989 Menchetti
4,850,385 A 7/1989 Harbeke
4,854,096 A 8/1989 Smolik
4,866,898 A 9/1989 LaRoche et al.
4,881,352 A 11/1989 Glockenstein
4,885,884 A 12/1989 Schilger
4,897,976 A 2/1990 Williams et al.
4,899,510 A 2/1990 Propst
4,914,880 A 4/1990 Albertini
4,918,761 A 4/1990 Harbeke
4,930,276 A 6/1990 Bawa et al.
4,935,281 A 6/1990 Tolbert et al.
4,982,540 A 1/1991 Thompson
4,986,040 A 1/1991 Prewer et al.
4,987,719 A 1/1991 Goodson, Jr.
4,992,310 A 2/1991 Gelb et al.
5,010,702 A 4/1991 Daw et al.
5,090,170 A 2/1992 Propst
5,094,780 A 3/1992 von Bonin
5,103,589 A 4/1992 Crawford
5,105,594 A 4/1992 Kirchner
5,111,579 A 5/1992 Andersen
5,125,203 A 6/1992 Daw
5,127,203 A 7/1992 Paquette
5,127,760 A 7/1992 Brady
5,140,792 A 8/1992 Daw et al.
5,146,723 A 9/1992 Greenwood et al.
5,152,113 A 10/1992 Guddas
5,155,957 A 10/1992 Robertson et al.
5,157,883 A 10/1992 Meyer
5,157,887 A 10/1992 Watterworth, III
5,167,876 A 12/1992 Lem
5,173,515 A 12/1992 von Bonin et al.
5,203,132 A 4/1993 Smolik
5,205,099 A 4/1993 Grünhage et al.
5,212,914 A 5/1993 Martin et al.
5,214,894 A 6/1993 Glesser-Lott
5,222,335 A 6/1993 Petrecca
5,228,254 A 7/1993 Honeycutt, Jr.
5,244,709 A 9/1993 Vanderstukken
5,279,091 A 1/1994 Williams et al.
5,282,615 A 2/1994 Green et al.
5,285,615 A 2/1994 Gilmour
5,315,804 A 5/1994 Attalla
5,319,339 A 6/1994 Leupold
5,325,651 A 7/1994 Meyer et al.
5,339,577 A 8/1994 Snyder
5,347,780 A 9/1994 Richards et al.
5,367,850 A 11/1994 Nicholas
5,374,036 A 12/1994 Rogers et al.
5,376,429 A 12/1994 McGroarty
5,390,458 A 2/1995 Menchetti
5,390,465 A 2/1995 Rajecki
5,394,665 A 3/1995 Johnson
5,412,919 A 5/1995 Pellock et al.
5,433,991 A 7/1995 Boyd, Jr. et al.
5,452,551 A 9/1995 Charland et al.
5,454,203 A 10/1995 Turner
5,456,050 A 10/1995 Ward
5,460,864 A 10/1995 Heitkamp
5,471,791 A 12/1995 Keller
5,471,805 A 12/1995 Becker
5,477,652 A 12/1995 Torrey et al.
5,502,937 A 4/1996 Wilson
5,531,051 A 7/1996 Chenier, Jr. et al.
5,552,185 A 9/1996 De Keyser
5,592,796 A 1/1997 Landers
5,604,024 A 2/1997 von Bonin
5,607,758 A * 3/1997 Schwartz ..... D06N 3/128
428/920
5,644,877 A 7/1997 Wood
5,687,538 A 11/1997 Frobosilo et al.
5,689,922 A 11/1997 Daudet
5,709,821 A 1/1998 von Bonin et al.
5,724,784 A 3/1998 Menchetti
5,735,100 A 4/1998 Campbell
5,740,635 A 4/1998 Gil et al.
5,740,643 A 4/1998 Huntley
5,755,066 A 5/1998 Becker
5,765,332 A 6/1998 Landin et al.
5,787,651 A 8/1998 Horn et al.
5,797,233 A 8/1998 Hascall
5,798,679 A 8/1998 Pissanetzky
5,806,261 A 9/1998 Huebner et al.
5,820,958 A 10/1998 Swallow
5,822,935 A 10/1998 Mitchell et al.
5,870,866 A 2/1999 Herndon
5,913,788 A 6/1999 Herren
5,921,041 A 7/1999 Egri, II
5,927,041 A 7/1999 Sedlmeier et al.
5,930,963 A 8/1999 Nichols
5,930,968 A 8/1999 Pullman
5,945,182 A 8/1999 Fowler et al.
5,950,385 A 9/1999 Herren
5,968,615 A 10/1999 Schlappa
5,968,669 A 10/1999 Liu et al.
5,970,672 A 10/1999 Robinson
5,974,750 A 11/1999 Landin et al.
5,974,753 A 11/1999 Hsu
6,023,898 A 2/2000 Josey
6,058,668 A 5/2000 Herren
6,061,985 A 5/2000 Kraus et al.
6,110,559 A 8/2000 De Keyser
6,116,404 A 9/2000 Heuft et al.
6,119,411 A 9/2000 Gil et al.
6,128,874 A 10/2000 Olson et al.
6,128,877 A 10/2000 Goodman et al.
6,131,352 A 10/2000 Barnes et al.
6,151,858 A 11/2000 Ruiz et al.
6,153,668 A 11/2000 Gestner et al.
6,176,053 B1 1/2001 St. Germain
6,182,407 B1 2/2001 Turpin et al.
6,189,277 B1 2/2001 Boscamp
6,207,077 B1 3/2001 Burnell-Jones
6,207,085 B1 3/2001 Ackerman
6,213,679 B1 4/2001 Frobosilo et al.
6,216,404 B1 4/2001 Vellrath
6,233,888 B1 5/2001 Wu
6,256,948 B1 7/2001 Van Dreumel
6,256,960 B1 7/2001 Babcock et al.
6,256,980 B1 7/2001 Lecordix et al.
6,279,289 B1 8/2001 Soder et al.
6,305,133 B1 10/2001 Cornwall
6,318,044 B1 11/2001 Campbell
6,374,558 B1 4/2002 Surowiecki
6,381,913 B2 5/2002 Herren
6,405,502 B1 6/2002 Cornwall
6,408,578 B1 6/2002 Tanaka et al.
6,430,881 B1 8/2002 Daudet et al.
6,470,638 B1 10/2002 Larson
6,487,825 B1 12/2002 Silik
6,574,930 B2 6/2003 Kiser
6,595,383 B2 7/2003 Pietrantoni
6,606,831 B2 8/2003 Degelsegger
6,647,691 B2 11/2003 Becker et al.
6,668,499 B2 12/2003 Degelsegger
6,679,015 B1 1/2004 Cornwall
6,688,499 B2 2/2004 Zhang

(56) References Cited

U.S. PATENT DOCUMENTS 6,698,146 B2 3/2004 Morgan et al.
6,705,047 B2 3/2004 Yulkowski
6,708,627 B1 3/2004 Wood
6,711,871 B2 3/2004 Beirise et al.
6,732,481 B2 5/2004 Stahl, Sr.
6,739,926 B2 5/2004 Riach et al.
6,748,705 B2 6/2004 Orszulak
6,783,345 B2 8/2004 Morgan et al.
6,792,733 B2 9/2004 Wheeler et al.
6,799,404 B2 10/2004 Spransy
6,843,035 B1 1/2005 Glynn
6,854,237 B2 2/2005 Surowiecki
6,871,470 B1 3/2005 Stover
6,951,162 B1 10/2005 Shockey et al.
7,043,880 B2 5/2006 Morgan et al.
7,059,092 B2 6/2006 Harkins et al.
7,104,024 B1 9/2006 deGirolamo et al.
7,152,385 B2 12/2006 Morgan et al.
7,191,845 B2 3/2007 Loar
7,240,905 B1 7/2007 Stahl
7,251,918 B2 8/2007 Reif et al.
7,302,776 B2 12/2007 Duncan et al.
7,398,856 B2 7/2008 Foster et al.
7,413,024 B1 8/2008 Simontacchi et al.
7,487,591 B2 2/2009 Harkins et al.
7,497,056 B2 3/2009 Surowiecki
7,506,478 B2 3/2009 Bobenhausen
7,513,082 B2 4/2009 Johnson
7,540,118 B2 6/2009 Jensen
7,594,331 B2 9/2009 Andrews et al.
7,603,823 B2 10/2009 Cann
7,610,725 B2 11/2009 Willert
7,617,643 B2 11/2009 Pilz et al.
7,681,365 B2 3/2010 Klein
7,685,792 B2 3/2010 Stahl, Sr. et al.
7,716,891 B2 5/2010 Radford
7,735,295 B2 6/2010 Surowiecki
7,752,817 B2 7/2010 Pilz et al.
7,775,006 B2 8/2010 Giannos
7,776,170 B2 8/2010 Yu et al.
7,797,893 B2 9/2010 Stahl, Sr. et al.
7,810,295 B2 10/2010 Thompson
7,814,718 B2 10/2010 Klein
7,827,738 B2 11/2010 Abrams et al.
7,836,652 B2 11/2010 Futterman
7,866,108 B2 1/2011 Klein
7,870,698 B2 1/2011 Tonyan et al.
7,921,537 B2 4/2011 Rodlin
7,921,614 B2 4/2011 Fortin et al.
7,941,981 B2 5/2011 Shaw
7,950,198 B2 5/2011 Pilz et al.
7,984,592 B1 7/2011 Jiras
8,056,293 B2 11/2011 Klein
8,061,099 B2 11/2011 Andrews
8,062,108 B2 11/2011 Carlson et al.
8,069,625 B2 12/2011 Harkins et al.
8,074,412 B1 12/2011 Gogan et al.
8,074,416 B2 12/2011 Andrews
8,079,188 B2 12/2011 Swartz et al.
8,087,205 B2 1/2012 Pilz et al.
8,100,164 B2 1/2012 Goodman et al.
8,132,376 B2 3/2012 Pilz et al.
8,136,314 B2 3/2012 Klein
8,151,526 B2 4/2012 Klein
8,181,404 B2 5/2012 Klein
8,225,581 B2 7/2012 Strickland et al.
8,281,552 B2 10/2012 Pilz et al.
8,318,304 B2 11/2012 Valenziano
8,322,094 B2 12/2012 Pilz et al.
8,353,139 B2 1/2013 Pilz
8,375,666 B2 2/2013 Stahl, Jr. et al.
8,389,107 B2 3/2013 Riebel et al.
8,413,394 B2 4/2013 Pilz et al.
8,468,759 B2 6/2013 Klein
8,495,844 B1 7/2013 Johnson
8,499,512 B2 8/2013 Pilz et al.
8,541,084 B2 9/2013 Deiss et al.
8,544,226 B2 10/2013 Rubel
8,555,566 B2 10/2013 Pilz et al.
8,578,672 B2 11/2013 Mattox et al.
8,584,415 B2 11/2013 Stahl, Jr. et al.
8,590,231 B2 11/2013 Pilz
8,595,999 B1 12/2013 Pilz et al.
8,596,019 B2 12/2013 Aitken
8,601,760 B2 12/2013 Hilburn
8,607,519 B2 12/2013 Hilburn
8,640,415 B2 2/2014 Pilz et al.
8,646,235 B2 2/2014 Hilburn, Jr.
8,671,632 B2 3/2014 Pilz et al.
8,728,608 B2 5/2014 Maisch
8,782,977 B2 7/2014 Burgess
8,793,947 B2 8/2014 Pilz et al.
8,826,599 B2 9/2014 Stahl
8,871,326 B2 10/2014 Flennert
8,938,922 B2 1/2015 Pilz et al.
8,950,132 B2 2/2015 Collins et al.
8,955,275 B2 2/2015 Stahl, Jr.
8,973,319 B2 3/2015 Pilz et al.
9,045,899 B2 6/2015 Pilz et al.
9,127,454 B2 9/2015 Pilz et al.
9,151,042 B2 10/2015 Simon et al.
9,157,232 B2 10/2015 Stahl, Jr.
9,206,596 B1 12/2015 Robinson
9,284,730 B2 3/2016 Klein
9,290,932 B2 3/2016 Pilz et al.
9,290,934 B2 3/2016 Pilz et al.
9,316,133 B2 4/2016 Schnitta
9,371,644 B2 6/2016 Pilz et al.
9,458,628 B2 10/2016 Pilz et al.
9,481,998 B2 11/2016 Pilz et al.
9,506,246 B2 11/2016 Joseph et al.
9,512,614 B2 12/2016 Klein et al.
9,523,193 B2 12/2016 Pilz
9,551,148 B2 1/2017 Pilz
9,616,259 B2 4/2017 Pilz et al.
9,637,914 B2 5/2017 Pilz et al.
9,683,364 B2 6/2017 Pilz et al.
9,719,253 B2 8/2017 Stahl, Jr. et al.
9,739,052 B2 8/2017 Pilz et al.
9,739,054 B2 8/2017 Pilz et al.
9,752,318 B2 9/2017 Pilz
9,879,421 B2 1/2018 Pilz
9,885,178 B1 2/2018 Barnes et al.
9,909,298 B2 3/2018 Pilz
9,931,527 B2 4/2018 Pilz et al.
9,995,039 B2 6/2018 Pilz et al.
10,000,923 B2 6/2018 Pilz
10,011,983 B2 7/2018 Pilz et al.
10,077,550 B2 9/2018 Pilz
10,166,418 B2 1/2019 Förg et al.
10,174,499 B1 1/2019 Tinianov et al.
10,184,246 B2 1/2019 Pilz et al.
10,214,901 B2 2/2019 Pilz et al.
10,227,775 B2 3/2019 Pilz et al.
10,246,871 B2 4/2019 Pilz
10,323,411 B2 6/2019 Ackerman et al.
10,406,389 B2 9/2019 Pilz et al.
10,472,819 B2 11/2019 Klein et al.
10,494,818 B2 12/2019 Maziarz
10,563,399 B2 2/2020 Pilz et al.
10,619,347 B2 4/2020 Pilz et al.
10,626,598 B2 4/2020 Klein
10,669,710 B2 6/2020 Förg
10,689,842 B2 6/2020 Pilz
10,731,338 B1 8/2020 Zemler et al.
10,753,084 B2 8/2020 Pilz et al.
10,900,223 B2 1/2021 Pilz
10,914,065 B2 2/2021 Pilz
10,920,416 B2 2/2021 Klein et al.
10,954,670 B2 3/2021 Pilz
11,041,306 B2 6/2021 Pilz et al.
11,060,283 B2 7/2021 Pilz et al.
11,111,666 B2 9/2021 Pilz
11,118,346 B2 * 9/2021 Klein ..... E04B 5/40

(56) References Cited

U.S. PATENT DOCUMENTS

| | | | | |
|---|---|---|---|---|
| 11,141,613 | B2 | 10/2021 | Pilz et al. | |
| 11,162,259 | B2 | 11/2021 | Pilz | |
| 11,230,839 | B2 * | 1/2022 | Klein | E04B 2/7411 |
| 11,268,274 | B2 | 3/2022 | Pilz | |
| 11,313,121 | B2 | 4/2022 | Quirijns et al. | |
| 11,421,417 | B2 | 8/2022 | Pilz et al. | |
| 11,466,449 | B2 | 10/2022 | Pilz et al. | |
| 11,486,150 | B2 | 11/2022 | Stahl et al. | |
| 11,512,464 | B2 | 11/2022 | Klein | |
| 11,560,712 | B2 | 1/2023 | Pilz et al. | |
| 2002/0029535 | A1 | 3/2002 | Loper | |
| 2002/0095908 | A1 | 7/2002 | Kiser | |
| 2002/0160149 | A1 | 10/2002 | Garofalo | |
| 2002/0170249 | A1 | 11/2002 | Yulkowski | |
| 2003/0079425 | A1 | 5/2003 | Morgan et al. | |
| 2003/0089062 | A1 | 5/2003 | Morgan et al. | |
| 2003/0196401 | A1 | 10/2003 | Surowiecki | |
| 2003/0213211 | A1 | 11/2003 | Morgan et al. | |
| 2004/0010998 | A1 | 1/2004 | Turco | |
| 2004/0016191 | A1 | 1/2004 | Whitty | |
| 2004/0045234 | A1 | 3/2004 | Morgan et al. | |
| 2004/0139684 | A1 | 7/2004 | Menendez | |
| 2004/0149390 | A1 | 8/2004 | Monden et al. | |
| 2004/0157012 | A1 | 8/2004 | Miller et al. | |
| 2004/0211150 | A1 | 10/2004 | Bobenhausen | |
| 2005/0031843 | A1 | 2/2005 | Robinson et al. | |
| 2005/0183361 | A1 | 8/2005 | Frezza | |
| 2005/0246973 | A1 | 11/2005 | Jensen | |
| 2006/0032163 | A1 | 2/2006 | Korn | |
| 2006/0123723 | A1 | 6/2006 | Weir et al. | |
| 2006/0137293 | A1 | 6/2006 | Klein | |
| 2006/0213138 | A1 | 9/2006 | Milani et al. | |
| 2006/0261223 | A1 | 11/2006 | Orndorff, II et al. | |
| 2007/0056245 | A1 | 3/2007 | Edmondson | |
| 2007/0068101 | A1 | 3/2007 | Weir et al. | |
| 2007/0130873 | A1 | 6/2007 | Fisher | |
| 2007/0193202 | A1 | 8/2007 | Rice | |
| 2007/0261343 | A1 | 11/2007 | Stahl, Sr. | |
| 2008/0053013 | A1 | 3/2008 | Tollenaar | |
| 2008/0087366 | A1 | 4/2008 | Yu et al. | |
| 2008/0134589 | A1 | 6/2008 | Abrams et al. | |
| 2008/0172967 | A1 | 7/2008 | Hilburn | |
| 2008/0196337 | A1 | 8/2008 | Surowiecki | |
| 2008/0250738 | A1 | 10/2008 | Howchin | |
| 2009/0090074 | A1 | 4/2009 | Klein | |
| 2009/0107064 | A1 | 4/2009 | Bowman | |
| 2009/0223159 | A1 | 9/2009 | Colon | |
| 2009/0282760 | A1 | 11/2009 | Sampson et al. | |
| 2010/0126092 | A1 | 5/2010 | Pilz et al. | |
| 2010/0170172 | A1 | 7/2010 | Klein | |
| 2010/0199583 | A1 | 8/2010 | Behrens et al. | |
| 2010/0266781 | A1 | 10/2010 | Kusinski et al. | |
| 2011/0011019 | A1 | 1/2011 | Stahl, Jr. et al. | |
| 2011/0041415 | A1 | 2/2011 | Esposito | |
| 2011/0056163 | A1 | 3/2011 | Kure | |
| 2011/0067328 | A1 | 3/2011 | Naccarato et al. | |
| 2011/0099928 | A1 | 5/2011 | Klein et al. | |
| 2011/0113709 | A1 | 5/2011 | Pilz et al. | |
| 2011/0146180 | A1 | 6/2011 | Klein | |
| 2011/0167742 | A1 | 7/2011 | Klein | |
| 2011/0185656 | A1 | 8/2011 | Klein | |
| 2011/0214371 | A1 | 9/2011 | Klein | |
| 2011/0247281 | A1 | 10/2011 | Pilz et al. | |
| 2011/0262720 | A1 | 10/2011 | Riebel et al. | |
| 2011/0274886 | A1 | 11/2011 | Flennert | |
| 2011/0302857 | A1 | 12/2011 | McClellan et al. | |
| 2012/0023846 | A1 | 2/2012 | Mattox et al. | |
| 2012/0180414 | A1 | 7/2012 | Burgess | |
| 2012/0247038 | A1 | 10/2012 | Black | |
| 2012/0266550 | A1 | 10/2012 | Naccarato et al. | |
| 2012/0297710 | A1 | 11/2012 | Klein | |
| 2013/0031856 | A1 | 2/2013 | Pilz et al. | |
| 2013/0118102 | A1 | 5/2013 | Pilz | |
| 2013/0118764 | A1 | 5/2013 | Porter | |
| 2013/0205694 | A1 | 8/2013 | Stahl, Jr. | |
| 2014/0219719 | A1 | 8/2014 | Hensley et al. | |
| 2014/0260017 | A1 | 9/2014 | Noble, III | |
| 2015/0086793 | A1 | 3/2015 | Kreysler et al. | |
| 2015/0135622 | A1 | 5/2015 | Muenzenberger et al. | |
| 2015/0135631 | A1 | 5/2015 | Förg | |
| 2015/0275506 | A1 | 10/2015 | Klein et al. | |
| 2015/0275507 | A1 | 10/2015 | Klein et al. | |
| 2015/0275510 | A1 | 10/2015 | Klein et al. | |
| 2015/0368898 | A1 | 12/2015 | Stahl, Jr. et al. | |
| 2016/0016381 | A1 | 1/2016 | Celis et al. | |
| 2016/0017598 | A1 | 1/2016 | Klein et al. | |
| 2016/0017599 | A1 | 1/2016 | Klein et al. | |
| 2016/0097197 | A1 | 4/2016 | Pilz | |
| 2016/0130802 | A1 | 5/2016 | Pilz | |
| 2016/0201893 | A1 | 7/2016 | Ksiezppolski | |
| 2016/0208484 | A1 | 7/2016 | Pilz | |
| 2016/0265219 | A1 | 9/2016 | Pilz | |
| 2016/0296775 | A1 | 10/2016 | Pilz et al. | |
| 2017/0016227 | A1 | 1/2017 | Klein | |
| 2017/0175386 | A1 | 6/2017 | Pilz | |
| 2017/0198473 | A1 | 7/2017 | Pilz | |
| 2017/0234004 | A1 | 8/2017 | Pilz | |
| 2017/0234010 | A1 | 8/2017 | Klein | |
| 2017/0260741 | A1 | 9/2017 | Ackerman et al. | |
| 2017/0306615 | A1 | 10/2017 | Klein et al. | |
| 2018/0010333 | A1 | 1/2018 | Förg | |
| 2018/0044913 | A1 | 2/2018 | Klein et al. | |
| 2018/0072922 | A1 | 3/2018 | Canale | |
| 2018/0171624 | A1 | 6/2018 | Klein et al. | |
| 2018/0171646 | A1 | 6/2018 | Stahl et al. | |
| 2018/0195282 | A1 | 7/2018 | Pilz | |
| 2019/0284797 | A1 | 9/2019 | Pilz | |
| 2019/0284799 | A1 | 9/2019 | Förg | |
| 2019/0316350 | A1 | 10/2019 | Pilz et al. | |
| 2019/0323234 | A1 | 10/2019 | Watanabe et al. | |
| 2019/0323347 | A1 | 10/2019 | Hensley et al. | |
| 2019/0360195 | A1 | 11/2019 | Pilz et al. | |
| 2020/0240140 | A1 | 7/2020 | Pilz | |
| 2020/0308829 | A1 * | 10/2020 | Hunsaker | E06B 1/003 |
| 2020/0362551 | A1 | 11/2020 | Klein et al. | |
| 2021/0010257 | A1 | 1/2021 | Klein et al. | |
| 2021/0017761 | A1 | 1/2021 | Klein et al. | |
| 2021/0040731 | A1 | 2/2021 | Pilz | |
| 2021/0062502 | A1 | 3/2021 | Archer et al. | |
| 2021/0101319 | A1 * | 4/2021 | Klein | E04C 2/322 |
| 2021/0148112 | A1 | 5/2021 | Klein | |
| 2021/0164222 | A1 | 6/2021 | Pilz | |
| 2021/0189721 | A1 | 6/2021 | Klein et al. | |
| 2021/0285208 | A1 | 9/2021 | Pilz | |
| 2021/0396004 | A1 | 12/2021 | Pilz | |
| 2022/0010553 | A1 | 1/2022 | Pilz et al. | |
| 2022/0023684 | A1 | 1/2022 | Pilz et al. | |
| 2022/0042303 | A1 | 2/2022 | Pilz | |
| 2022/0056686 | A1 | 2/2022 | Pilz | |
| 2022/0098856 | A1 | 3/2022 | Pilz | |
| 2022/0162851 | A1 | 5/2022 | Pilz | |
| 2022/0259852 | A1 | 8/2022 | Pilz | |
| 2022/0268017 | A1 | 8/2022 | Pilz et al. | |
| 2022/0349177 | A1 | 11/2022 | Pilz | |
| 2022/0401767 | A1 | 12/2022 | Pilz | |
| 2023/0115315 | A1 | 4/2023 | Pilz et al. | |

FOREIGN PATENT DOCUMENTS

| | | | | |
|---|---|---|---|---|
| CA | 2803439 | | 3/2017 | |
| CA | 3041494 | A1 * | 10/2019 | A62C 2/06 |
| DE | 60213279 | T2 | 7/2007 | |
| EP | 0 335 347 | | 10/1989 | |
| EP | 0335347 | A1 * | 10/1989 | E06B 5/164 |
| EP | 0 346 126 | | 12/1989 | |
| EP | 3 196 376 | | 7/2017 | |
| EP | 3 348 729 | | 7/2018 | |
| EP | 3 556 957 | A1 | 10/2019 | |
| GB | 2 159 051 | | 11/1985 | |
| GB | 2411 212 | | 8/2005 | |
| GB | 2 424 658 | | 10/2006 | |
| JP | H06-042090 | A | 2/1994 | |
| JP | H06-146433 | | 5/1994 | |
| JP | H06-220934 | | 8/1994 | |

(56) References Cited

FOREIGN PATENT DOCUMENTS

| | | | | |
|---|---|---|---|---|
| JP | H07-004620 U | | 1/1995 | |
| KR | 100664665 B1 * | | 6/2006 | ..... B32B 27/06 |
| WO | WO 2003/038206 | | 5/2003 | |
| WO | WO-2004071584 A1 * | | 8/2004 | ..... A62C 2/06 |
| WO | WO 2007/103331 | | 9/2007 | |
| WO | WO 2013/113734 | | 8/2013 | |
| WO | WO 2017/129398 | | 1/2017 | |
| WO | WO 2019/108295 | | 6/2019 | |

OTHER PUBLICATIONS

U.S. Appl. No. 17/821,128, filed Aug. 19, 2022, Pilz et al.
U.S. Appl. No. 17/822,091, filed Aug. 24, 2022, Pilz.
BlazeFrame 2009 catalog of products, available at least as of Mar. 4, 2010 from www.blazeframe.com, in 20 pages.
Catalog page from Stockton Products, printed from www.stocktonproducts.com, on Dec. 16, 2007, showing #5 Drip, in 1 page.
ClarkDietrich Building Systems, Product Submittal Sheet, (FTSC) Flat Trail Vertical Slide Clip. CD-FTSC11 Jul. 2011. 1 page.
DoubleTrackTM information sheets by Dietrich Metal Framing, in 2 pages; accessible on Internet Wayback Machine on Jul. 8, 2006.
FireStikTM by CEMCO Brochure, published on www.firestik.us, in 18 pages; accessible on Internet Wayback Machine on Aug. 13, 2007.
Information Disclosure Statement letter; U.S. Appl. No. 12/196,115, dated Aug. 4, 2011.
International Search Report for Application No. PCT/US2008/073920, dated Apr. 9, 2009.
"Intumescent Expansion Joint Seals", Astroflame; http://www.astroflame.com/intumescent_expansionjoint_seals; Jul. 2011; 4 pages.
James A. Klein's Answer, Affirmative Defenses and Counterclaims to Third Amended Complaint; U.S. District Court, Central District of California; Case No. 2:12-cv-10791-DDP-MRWx; Filed Sep. 17, 14; pp. 1-37.
Letter from Thomas E. Loop; counsel for defendant; Jun. 26, 2015.
Expert Report of James William Jones and exhibits; Case No. CV12-10791 DDP (MRWx); May 18, 2015.
Letter from Ann G. Schoen of Frost Brown Todd, LLC; Jun. 24, 2015.
"System No. HW-D-0607", May 6, 2010, Metacaulk, www.rectorseal.com, www.metacault.com; 2008 Underwriters Laboratories Inc.; 2 pages.
Trim-Tex, Inc., Trim-Tex Wall Mounted Deflection Bead Installation Instructions, 2 pages. [Undated. Applicant requests that the Examiner review and consider the reference as prior art for the purpose of examination.].
"Wall Mounted Deflection Bead," Trim-Tex Drywall Products; Oct. 9, 2016; 3 pages.
Letter by Thomas E. Loop in *Klein, James* v. *CEMCO*, dated Nov. 4, 2011, in 10 pages.
Request for Ex Parte Reexamination of U.S. Pat. No. 10,406,389 issued Sep. 10, 2019 by Thomas E. Loop (3rd Party Requestor) and supporting documents filed Aug. 4, 2022 (64 pages).
Claim Construction Order issued Oct. 19, 2021, in *Seal3Safti, Inc.* v. *CEMCO*, USDC Case No. 2:20-cv-10409-MCS, Document No. 65, (28 pages).
Plaintiff's Brief on Bench Trial Issue No. 2 filed Jun. 3, 2022, in *Seal4Safti, Inc.* v. *CEMCO*, USDC Case No. 2:20-cv-10409-MCS, (27 pages).
Defendant's Opposition to Brief on Bench Trial Issue No. 2 filed Jun. 27, 2022, in *Seal4Safti, Inc.* v. *CEMCO*, USDC Case No. 2:20-cv-10409-MCS, (16 pages).
Claim Construction Order issued Apr. 17, 2019, in *CEMCO* v. *James A. Klein* related to U.S. Pat. Nos. 7,681,365; 7,814,718; 8,136,314, and 8,151,526; USWW Case No. C18-0659JLR, Document No. 98, (35 pages).
U.S. Reexamination No. 90/020,150 filed by 3rd Party Loop IP on Sep. 19, 2022, in Re U.S. Pat. No. 10,406,389 issued Sep. 10, 2019 (221 pages).
U.S. Response to Office Action dated Dec. 28, 2022, filed on Feb. 27, 2023 in Reexamination No. 90/020,150.
U.S. Office Action dated May 11, 2023 in Reexamination No. 90/020,150.
U.S. Appl. No. 18/150,111, filed Jan. 4, 2023, Pilz et al.

* cited by examiner

FIRE-RATED WALL AND CEILING SYSTEM

RELATED APPLICATIONS

Related applications are listed in an Application Data Sheet (ADS) accompanying this application. The entirety of each related application listed on the ADS is expressly incorporated by reference herein.

BACKGROUND OF THE INVENTION

Field of the Invention

This application is directed toward fire-rated wall construction components for use in building construction.

Description of the Related Art

Fire-rated wall construction components and assemblies are commonly used in the construction industry. These components and assemblies are aimed at preventing fire, heat, and smoke from leaving one portion of a building or room and entering another, usually through vents, joints in walls, or other openings. The components often incorporate the use of a fire-retardant material which substantially blocks the path of the fire, heat, and smoke for at least some period of time. Intumescent materials work well for this purpose, since they swell and char when exposed to flames, helping to create a barrier to the fire, heat, and smoke.

One example of a fire-rated wall construction component is the Firestik® head-of-wall fireblock product. The Firestik® head-of-wall fireblock incorporates a metal profile with a layer of intumescent material on its inner surface. The metal profile of the Firestik® head-of-wall fireblock is independently and rigidly attached to a wall component, such as the bottom of a floor or ceiling, and placed adjacent to other wall components, such as a stud and track. The intumescent material, which is adhered to the inner surface of the metal profile, faces the stud and track, and the space created in between the intumescent material and the stud and track allows for independent vertical movement of the stud in the track when no fire is present.

When temperatures rise, the intumescent material on the Firestik® head-of-wall fireblock expands rapidly. This expansion creates a barrier which encompasses, or surrounds the stud and track and substantially prevents fire, heat, and smoke from moving through the spaces around the stud and track and entering an adjacent room for at least some period of time.

While the Firestik® head-of-wall fireblock serves to prevent fire, heat, and smoke from moving through wall joint openings, it also requires independent attachment and proper spacing from wall components. It would be ideal to have wall components and systems which themselves already incorporate a fire-retardant material.

An additional problem regarding current fire-rated wall components concerns ventilation. Exterior soffits for balconies or walkways are required to be fire rated. However, these soffits need to be vented to prevent the framing members from rotting. The rot is caused when airflow is taken away and condensation forms inside the framing cavity. The moisture from the condensation attacks the framing members and destroys them from the inside out. In many cases, the deterioration is not noticed until the framing is completely destroyed. Therefore, a fire-rated wall component is needed which accommodates proper ventilation during times when no fire or elevated heat is present, and seals itself when fire or elevated heat is present.

SUMMARY OF THE INVENTION

The present application is directed toward fire-rated wall construction components and systems for use in building construction. The term "wall," as used herein, is a broad term, and is used in accordance with its ordinary meaning. The term may include, but is not limited to, vertical walls, ceilings, and floors. It is an object of the application to provide wall components and systems which have fire-retardant characteristics. It is also an object of the application to provide wall components and systems which allow for needed ventilation during times when no fire or elevated heat is present.

To achieve some or all of these objects, an embodiment of a wall system is provided that takes two separate components, a wall component and intumescent material, and combines the two for use in building construction. The embodiment includes at least one surface on a wall component capable of accepting intumescent material. In some embodiments, the outer surface of the intumescent material sits flush with a second surface of the wall component. This allows the wall component to retain its general shape and geometry without creating unwanted edges, protrusions, or uneven shapes. It also removes the need for a separate product or wall component to be installed outside or adjacent to a stud or track. In other arrangements, it may be desirable for the outer surface of the intumescent material to extend above the second surface of the wall component to, for example, facilitate contact between the intumescent material and another component or surface. In some arrangements, it may be desirable for the outer surface of the intumescent material to be positioned below the second surface of the wall component.

In an embodiment which resembles a vent or ventilation system, the intumescent material is positioned within an interior space of a vent. The vent may include first and second components, each including vent holes. In some arrangements, the intumescent material may include a set of holes, especially when the intumescent material is covering vent holes of the vent component(s). The term "holes," as used herein, is a broad term, and is used in accordance with its ordinary meaning. The term includes, but is not limited to, holes, mesh, and slots. When the vent is in use, the holes in the vent surface (and, in some arrangements, the holes in the intumescent material) allow for continuous air flow through the vent. If provided, the holes in the intumescent material and the holes in the vent surface need not match up co-axially, as long as air flow is permitted. In some embodiments, the holes in the intumescent material may line up co-axially with the holes in the vent surface. Additionally, in some embodiments a flat strap may define a portion of the vent and may sit above the intumescent material. The flat strap may be a discrete piece attached separately, or may already be an integral part of the vent itself. The flat strap has its own set of holes which, when in use, allow for continuous air flow through the vent. In some embodiments the holes may be aligned co-axially with both the holes in the vent surface and the holes in the intumescent material. By having holes in both the vent and strap, air can flow through the vent, intumescent material (in some embodiments), and strap during times when there is no fire or elevated heat. When the temperature rises, however, the intumescent material will expand quickly and block air pathways. In this manner, the entire vent will be sealed, substantially preventing fire, heat, and smoke from reaching other rooms or parts of the building for at least some period of time. The intumescent material may be a strip of material that can be handled separately from the vent, or may be a layer of material applied to the vent (e.g., sprayed or painted onto the vent), among other possibilities.

In yet another embodiment, a wall system is provided which comprises a first wall component, a second wall component, a flat strap of material attached to the first wall component, and a strip of fire-retardant material located on the flat strap.

In yet another embodiment, a wall system is provided which comprises a deck with a flute, a wall generally aligned along the length of the flute, a flat strap located between the deck and the wall and attached to the deck, and a pair of fire-retardant material strips, one on either side of the flute, located on the flat strap between the flat strap and the deck.

In yet another embodiment, a pre-formed fire-retardant sponge is provided for use in a flute of a fluted deck, the sponge comprising a body having substantially the same shape as the shape of a flute of a fluted deck, the body being formed of compressible material and having at least one layer of fire-retardant material, and the body having an uncompressed size larger than that of the size of the flute.

In yet another embodiment, a fire-retardant wall system is provided comprising a track for receiving wall studs, the track comprising a web and flange, the track further comprising at least one surface for accepting fire-retardant material thereon, the at least one surface configured such that when the track is attached to a deck, the fire-retardant material can expand and seal any gaps present between the track and the deck when the fire-retardant material is exposed to elevated heat. The system further comprises at least one wall stud received within the track, at least one piece of drywall attached to the at least one wall stud, and an elongate protrusion or sealing element located along the flange.

In yet another embodiment, a fire-retardant wall system is provided comprising a track for receiving wall studs, the track comprising a web and flange, the track further comprising at least one surface for accepting fire-retardant material thereon, the at least one surface configured such that when the track is attached to a deck, the fire-retardant material can expand and seal any gaps present between the track and the deck when the fire-retardant material is exposed to elevated heat. The system further comprises fire-retardant material attached to the at least one surface of the track, the fire-retardant material being located along at least a portion of the flange, at least one wall stud received within the track, at least one piece of drywall attached to the at least one wall stud, and an elongate protrusion located along the flange between a free end of the flange and an edge of the fire-retardant material.

An embodiment involves a fire rated metal stud framing wall and ceiling system including a metal bottom track having a web, a first flange and a second flange. The first and second flanges extend in an upward direction from opposing side edges of the web. The bottom track defines an interior space between the web and the inwardly-facing surfaces of the first and second flanges. A plurality of metal studs are spaced from one another along the bottom track. Each of the plurality of studs has a bottom end received within the interior space of the bottom track and each of the studs extends in a generally vertical direction from the bottom track. A metal top track includes a web, a first flange and a second flange. The first and second flanges extend in a downward direction from opposing side edges of the web. The top track defines an interior space between the web and the inwardly-facing surfaces of the first and second flanges. Upper ends of each of the plurality of studs are received within the interior space of the top track. At least one heat-expandable, intumescent material strip extends along a length of the top track. The intumescent material strip is attached to the top track and has at least a first surface facing the top track and a second surface. The top track is secured to a ceiling and the at least one intumescent material strip is located on the top track such that the second surface of the at least one intumescent material strip contacts the ceiling. The second surface of the at least one intumescent material strip defines a width that is less than the width of the web of the metal top track.

In some arrangements, each of the first flange and the second flange include planar portions that extend a substantial depth of the top track. The top track can include a recess defined by at least one side edge of the web, wherein the intumescent material strip is positioned within the recess. The second surface of the intumescent material strip can be opposite the first surface. The intumescent material strip can have an exposed third surface that faces the same direction as an outer surface of one of the first and second flanges. Each of the first and second flanges include a plurality of vertically-oriented slots. The at least one intumescent material strip can be a first strip and a second strip, wherein the first strip and second strip are adhesively attached to the top track along respective outermost surfaces which come in contact with the ceiling. The system can include at least one wall board coupled to the plurality of studs. The bottom track and the top track can be constructed from a cold formed steel. In some embodiments, the at least one intumescent material strip is adhesively attached to the top track.

An embodiment involves a fire rated metal stud framing wall and ceiling system including a metal bottom track having a web, a first flange and a second flange. The first and second flanges extend in an upward direction from opposing side edges of the web. The bottom track defines an interior space between the web and the inwardly-facing surfaces of the first and second flanges. A plurality of metal studs are spaced from one another along the bottom track and each of the studs has a bottom end received within the interior space of the bottom track. Each of the studs extends in a generally vertical direction from the bottom track. A metal top track includes a web, a first flange and a second flange. The first and second flanges extend in a downward direction from opposing side edges of the web. The top track defines an interior space between the web and the inwardly-facing surfaces of the first and second flanges. Upper ends of each of the plurality of studs are received within the interior space of the top track. A first heat-expandable, intumescent material strip extends along a length of the top track on a first side thereof and a second heat-expandable, intumescent material strip extends along a length of the top track on a second side thereof. The first and second intumescent material strips are attached to the top track and each have at least a first surface facing the top track and a second surface. The second surface defines a width and the combined widths of the second surfaces of the first and second intumescent material strips is less than the width of the web of the metal top track. The top track is secured to a ceiling and the first and second intumescent material strips are located on the top track such that the second surface of each of the first and second intumescent material strips contact the ceiling.

In some arrangements, each of the first flange and the second flange comprise planar portions that extend a substantial depth of the top track. The top track can also include a first recess defined by a first side edge of the web and a second recess defined by a second side edge of the web, wherein the first intumescent material strip is positioned within the first recess and the second intumescent material strip is positioned within the second recess. The second surface can be opposite the first surface on each of the first and second intumescent material strips. Each of the intumescent material strips can further include an exposed third surface that faces the same direction as an outer surface of the respective one of the first and second flanges closest to the intumescent material strip. Each of the first and second flanges can include a plurality of vertically-oriented slots. At least one wall board can be coupled to the plurality of studs. The studs, the bottom track and the top track can be constructed from a cold formed steel. The first and second intumescent material strips can be adhesively attached to the top track.

Additional embodiments involve individual components of the systems described above, such as the individual flat straps, tracks or vent components, for example. In addition, embodiments of the present invention include methods of manufacturing the wall systems, vents or vent systems described above. Furthermore, other embodiments involve methods of assembling the wall systems, vents or vent systems described above.

BRIEF DESCRIPTION OF THE DRAWINGS

These and other features, aspects and advantages of the various devices, systems and methods presented herein are described with reference to drawings of certain embodiments, which are intended to illustrate, but not to limit, such devices, systems, and methods. The drawings include fourteen (14) figures. It is to be understood that the attached drawings are for the purpose of illustrating concepts of the embodiments discussed herein and may not be to scale.

FIG. 10D illustrates the embodiment of 10A, except with the fasteners moved in.

DETAILED DESCRIPTION OF THE PREFERRED EMBODIMENTS

Figure 14:
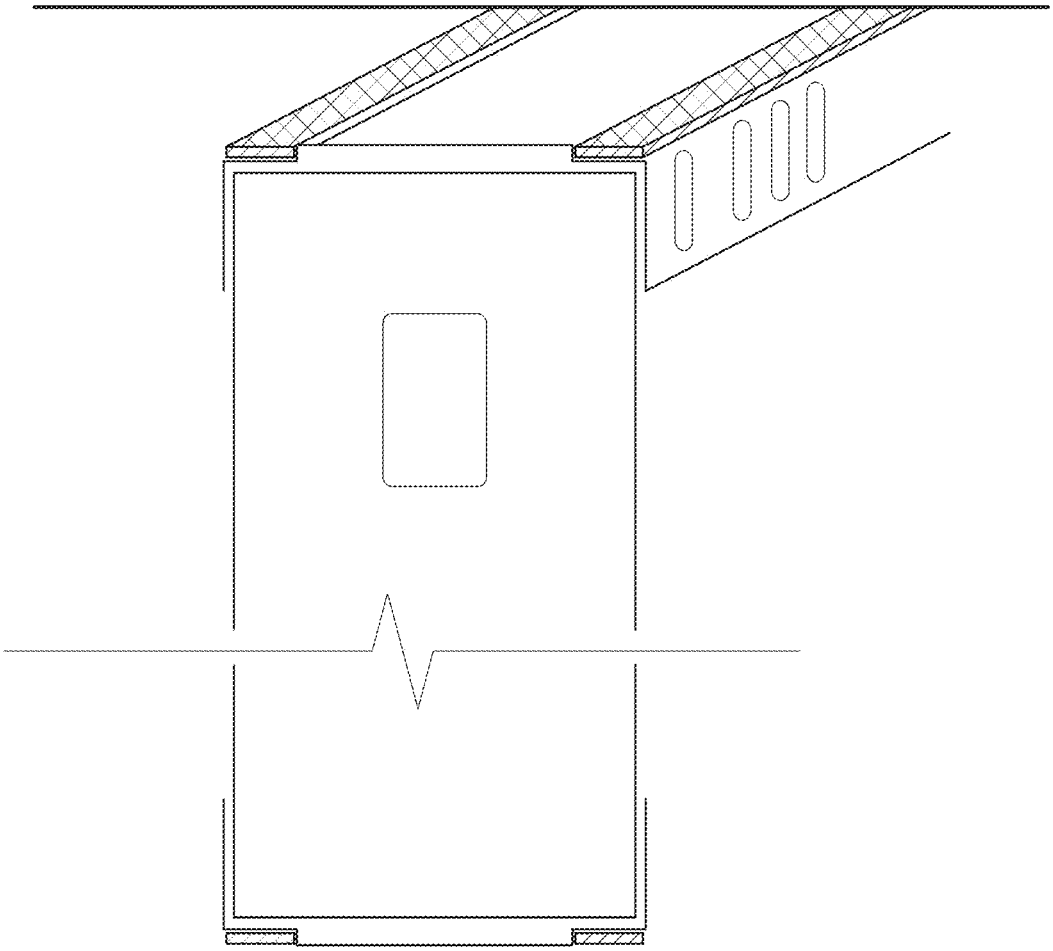
FIG. 14 illustrates a cross-sectional view of an embodiment of a wall assembly.

The preferred embodiments of the present invention are directed toward fire-rated wall construction components and systems for use in building construction. Fire-rated wall construction components and assemblies are commonly used in the construction industry. These components and assemblies are aimed at preventing fire, heat, and smoke from leaving one portion of a building or room and entering another, usually through vents, joints in walls, or other openings. The components and assemblies often incorporate the use of some sort of fire-retardant material, such as intumescent material, which substantially blocks the path of the fire, heat, and smoke for at least some period of time. One embodiment comprises metal stud framing and intumescent and combines the two into a single component which is then incorporated into a metal stud framing wall and ceiling system. The metal stud framing wall comprises a top track with intumescent attached adhesively which allows the intumescent to be sandwiched between two hard surfaces (see FIG. 14).

Figure 1:
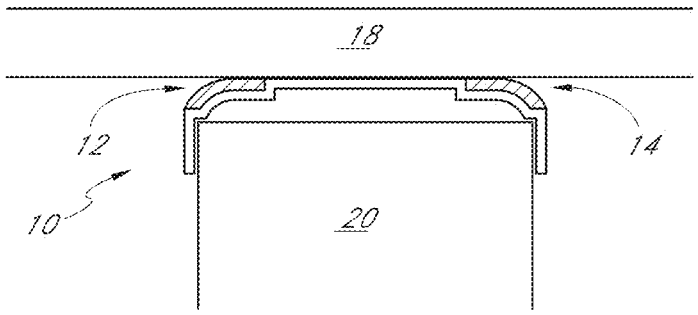
FIG. 1 illustrates a cross-sectional view of an embodiment of a fire-rated wall component connected to a floor and stud element.

FIG. 1 illustrates a cross-sectional view of an embodiment of a fire-rated wall component 10 connected to a floor or ceiling element 18 and stud element 20. The wall component 10 is used as a track for holding a stud within a vertical wall, and may include slots along its sides. The slots provide areas to accommodate fasteners for connection with the studs and allow for vertical movement of the attached studs during an earthquake or some other event where vertical movement of the studs is desired.

Figure 2:
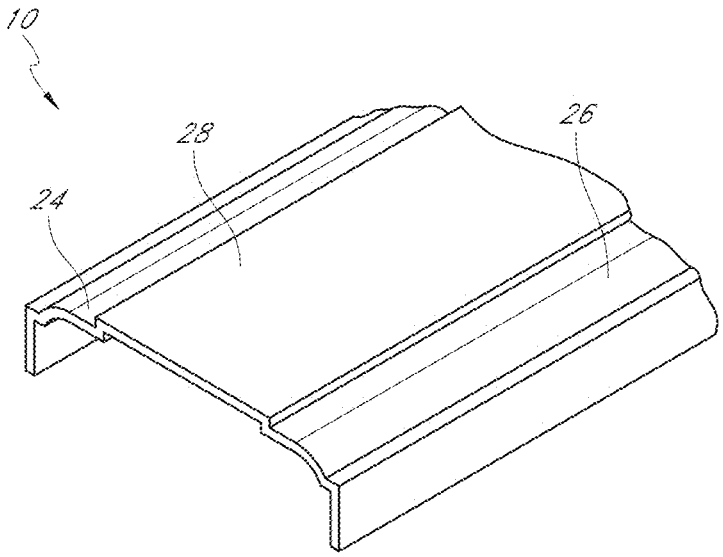
FIG. 2 illustrates a perspective view of an embodiment of a fire-rated wall component with arcuate or curved portions.

As can be seen in FIG. 2, wall component or header track 10 has both a flat top surface 28 and two arcuate surfaces 24 and 26. Top surface 28 is flat for ease of attachment to the bottom surface of a floor or ceiling 18. The two arcuate surfaces 24 and 26 are designed to receive intumescent material. The arcuate nature of the surfaces 24 and 26 can encourage the intumescent material, in at least some embodiments, to expand in a more radial direction from the top of the wall component 10 when subjected to elevated levels of heat, thereby filling in a larger area between and alongside the header track and floor 18. In other embodiments, the surfaces 24, 26 can have other shapes or configurations.

Figure 3:
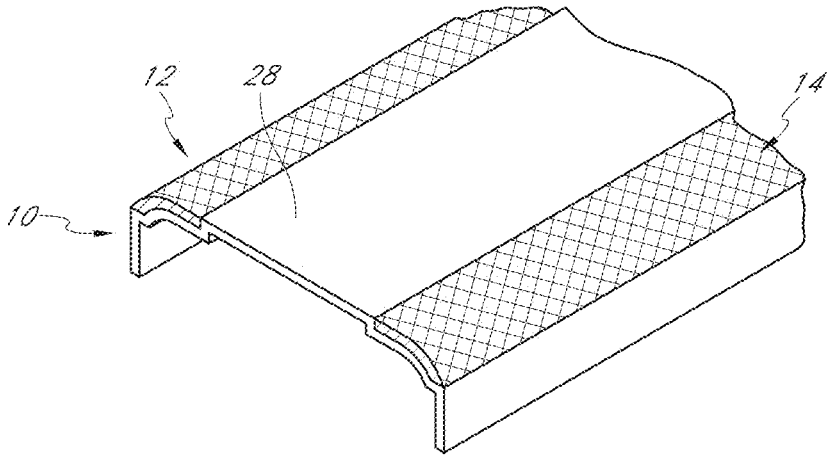
FIG. 3 illustrates a perspective view of an embodiment of a fire-rated wall component with arcuate portions, including intumescent material.

The intumescent material, identified as 12 and 14 in FIGS. 1 and 3, is bonded to arcuate surfaces 24 and 26. The term "bonded," as used herein, is a broad term, and is used in accordance with its ordinary meaning. The term includes, but is not limited to, mechanically bonded or bonded using adhesive. In some embodiments, when the intumescent material is bonded, an outer surface of the intumescent material will be flush with top surface 28. This allows top surface 28 to remain flush, or at least partially flush, with the bottom of floor element 18, and may aid in the installation of wall component 10 to a floor or ceiling. This flush attachment additionally allows the wall component 10 to retain a fluid or smooth-shaped geometry free of added edges, overlaps, or protrusions. In doing so, the area of contact between the intumescent material and the floor element 18 can inhibit air and sound from moving past the header track 10. In other arrangements, it may be desirable for the outer surface of the intumescent material to extend above the top surface 28 to, for example, ensure contact between the intumescent material and the floor element 18. In some arrangements, it may be desirable for the outer surface of the intumescent material to be positioned below the second surface of the wall component.

By incorporating intumescent material onto a wall component such as a track for studs in the manner shown, it becomes unnecessary to use or attach additional features or devices to the wall component. Instead, when the temperature rises near the wall component 10, the intumescent material 12 and/or 14 will heat up. At some point when the intumescent material becomes hot enough, it will quickly expand to multiple times its original volume. This intumescent material will expand towards the floor or ceiling element 18 and outwards toward any open space. This helps to substantially prevent fire, heat, and smoke from moving past, through, or around wall component 10 and stud 20 for at least some period of time.

Figure 4:
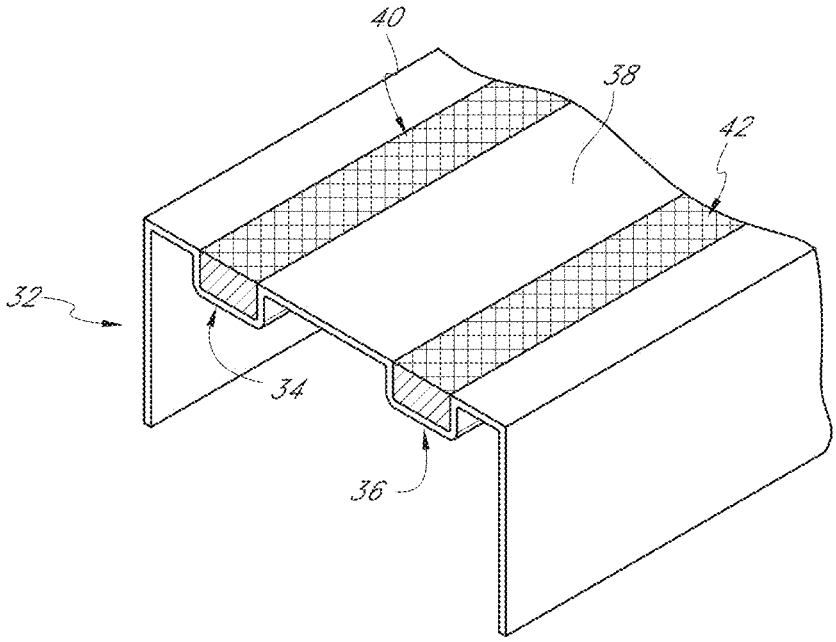
FIG. 4 illustrates a perspective view of an embodiment of a fire-rated wall component with channels or slots and intumescent material in the slots.

FIG. 4 illustrates another embodiment of a fire-rated wall component 32. In this embodiment, the wall component 32 again takes the form of a track member for use in holding studs in place within a vertical wall. However, here the wall component 32 has two slots or channels, shown as 34 and 36, wherein the intumescent material 40 and 42 is attached. As can be seen in the drawing, the top surface layers of intumescent material 40 and 42 are flush with the top surface 38 of wall component 32. This allows the top surface 38 of wall component 32 to maintain a smooth geometry, which may aid in the installation of wall component 32 to a floor, ceiling or intersecting wall. This flush attachment additionally allows the wall component 10 to retain a fluid or smooth-shaped geometry free of added edges, overlaps, or protrusions. However, a flush attachment as described above is not essential to the success of the present invention.

It is possible that more than two slots could be used in the type of embodiment shown in FIG. 4, or even as few as one. The purpose of having the intumescent material located in the slots 34 and 36 is to create fire protection areas. When the intumescent material 40 and 42 becomes hot, it will expand rapidly into the open areas around it. Much as in the embodiment shown in FIGS. 1-3, this expansion will help to create a barrier, or seal, substantially preventing fire, heat, and smoke from moving from one area of a building to another for at least some period of time.

Figure 5A:
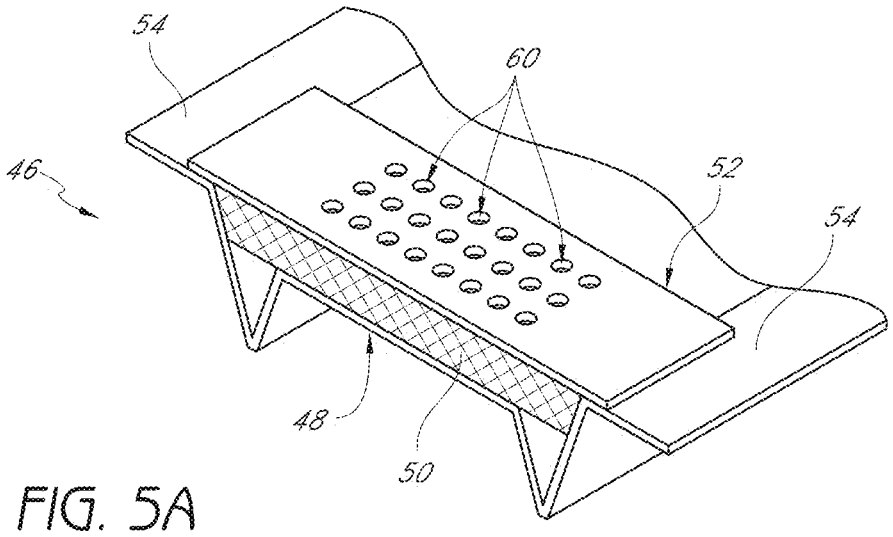
FIGS. 5A and 5B illustrate perspective views of embodiments of a fire-rated wall component including holes for ventilation.
Figure 5B:
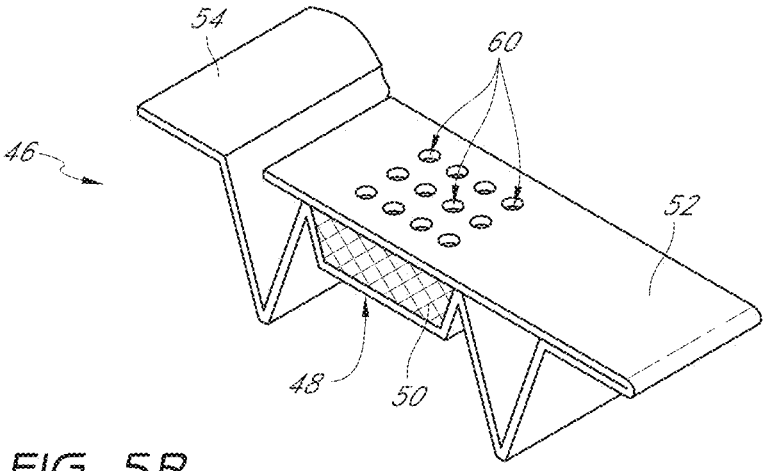
Figure 6A:
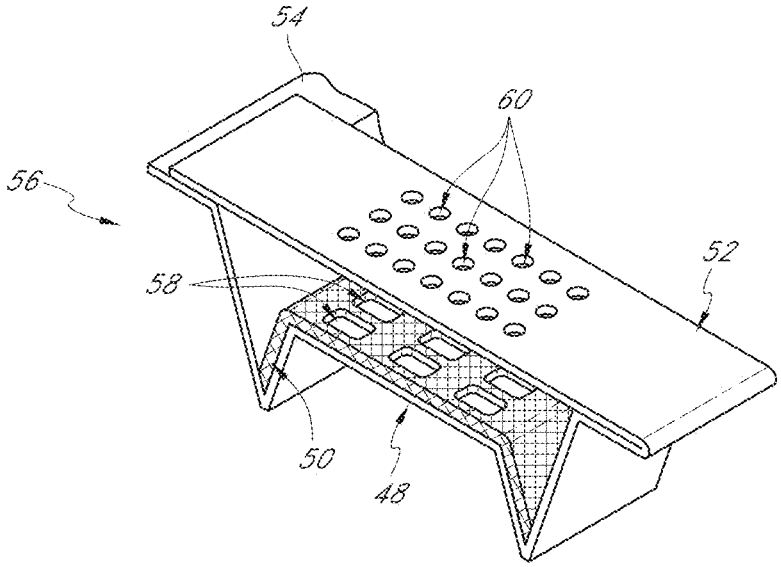
FIGS. 6A and 6B illustrate perspective views of an embodiment of a fire-rated wall component including holes for ventilation.
Figure 6B:
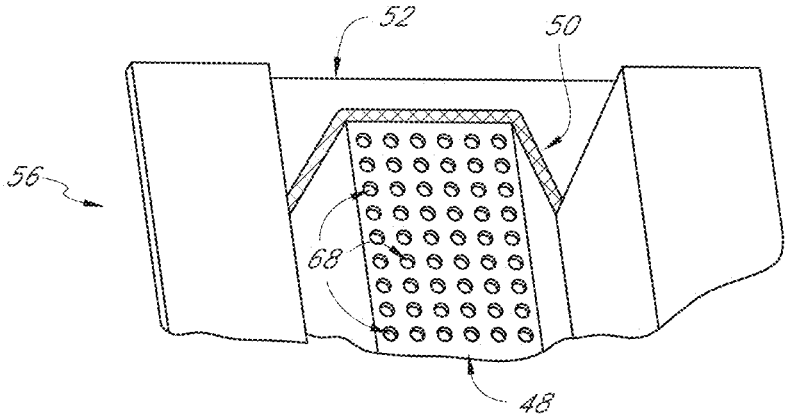

FIGS. 5A and 5B illustrate other embodiments of a fire-rated wall component 46. Here, the wall component takes the form of a soffit vent. The wall component 46 has a lower ventilation area 48 which includes a set or series of ventilation holes. These holes, which are hidden from view in FIGS. 5A and 5B, but are shown in FIG. 6B, allow air and other matter to travel between floors and rooms in a building, or between the outside of a building and the interior of a building.

As can be seen in FIG. 5A, a strip of intumescent material 50 is provided within the vent 46 and above ventilation area 48. The intumescent material 50 may be loosely positioned within the vent 46 or, as illustrated, may be attached adjacent to one or more components of the vent 46. The top surface of the intumescent material is flush with the top surface 54 of wall component 46. This allows for easy installation and use of a flat strap 52, which may be a separate member from the vent 46 or may be integrated with the vent 46. A flush fit, however, is not essential to the success of the present invention.

In some arrangements, especially if covering the holes of the ventilation area 48, the intumescent material 50 may be provided with a series of surfaces defining holes. These holes are hidden from view in FIGS. 5A and 5B but are shown in FIG. 6A. The holes allow air and other matter to continue to travel between floors and rooms in a building, or between the outside of a building and the interior of a building. Flat strap 52 also has a series of holes 60 located in its center area. This series of holes, much like the ventilation and intumescent material holes, allows air and other matter to travel between floors and rooms in a building, or between the outside of a building and the interior of a building.

The intumescent material 50 may occupy a portion or all of the interior space defined by the vent 46. In one or more arrangements, the intumescent material 50 occupies only a portion of the interior space to facilitate air flow through the vent 46. When the intumescent material 50 becomes hot, it will expand to many times its original size into the open areas around it. Much as in the embodiments shown in FIGS. 1-4, this expansion will help to create a barrier, or seal, inhibiting or at least substantially preventing fire, heat, and smoke from moving from one area of a building to another for at least some period of time.

FIGS. 6A and 6B illustrate another embodiment of a fire-rated wall component 56. In FIG. 6A, intumescent material holes 58 are visible, and the intumescent material 50 extends along the sides of vent area 48. When the intumescent material 50 becomes hot, it expands rapidly, filling much if not all of the space underneath the flat strap 52. This expansion substantially cuts off at least a substantial amount of air movement through the vent surface 48, and inhibits or at least substantially prevents fire, heat, and smoke from moving through the vent for at least some period of time. As can be seen in the embodiment in FIG. 6A, the flat strap 52 is formed as an integral part of the wall component 56. In other embodiments, the flat strap 52 may be a discrete piece attached separately.

FIG. 6B illustrates the bottom view of fire-rated wall component 56. Here, ventilation holes 68 can be seen in the vent area 48. The intumescent material 50 is attached to both the vent area 48 and along its extended sides. The intumescent material 50 can be a single piece of material, or can be made up of several pieces. The intumescent material 50 can be secured to the strap 52 or wall component 56 by any suitable means. For example, in one arrangement, the intumescent material 50 includes an adhesive backing, which permits the intumescent material 50 to be secured to the strap 52 or wall component 56. In an alternative arrangement, the intumescent material 50 may be secured to the strap 52 or wall component 56 by a mechanical fastener, such as a screw or rivet, for example. Other suitable mechanisms or methods may also be used. The intumescent material 50 may be secured to the strap 52 or wall component 56 during the manufacturing process or in the field.

Figure 7A:
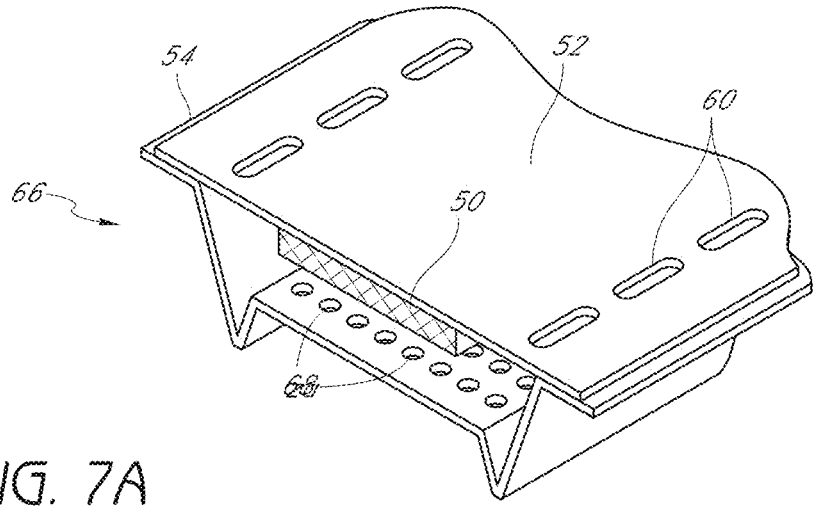
FIGS. 7A and 7B illustrate perspective views of an embodiment of a fire-rated wall component including holes for ventilation.
Figure 7B:
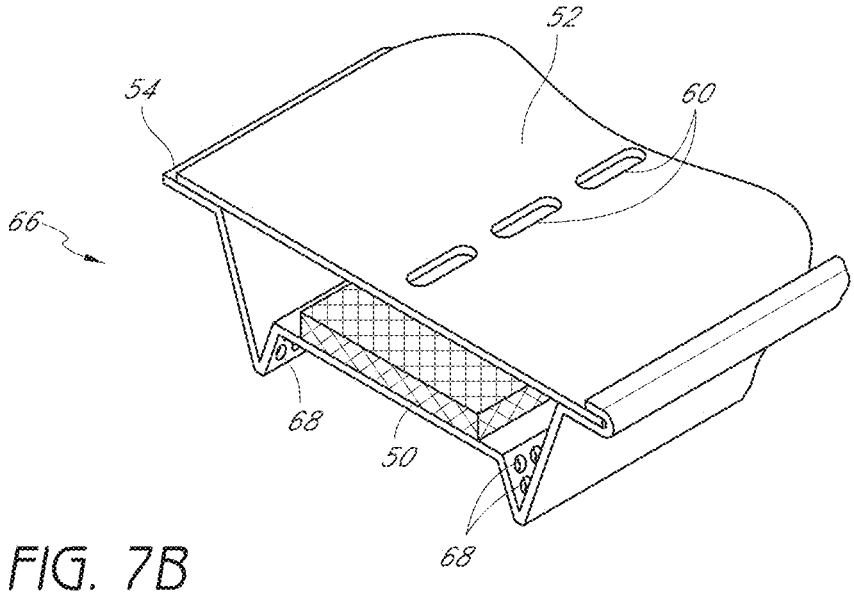

FIGS. 7A and 7B illustrate another embodiment of a fire-rated wall component 66. With reference to FIG. 7A, the wall component 66 can include a flat strap 52 with intumescent material 50 attached underneath, such that the intumescent material faces the inside area of the vent. In at least some embodiments the flat strap can comprise 20 gauge sheet metal, and the intumescent material can be about 2 mm thick and about 1¼" wide. Other gauges, sizes, and shapes are also possible. The intumescent material can be attached to the flat strap 52 by various means, including but not limited to adhesive tape and/or mechanical fasteners. The flat strap 52 can be a discrete piece attached separately to the top surface 54, or can be formed as an integral part of the wall component, as shown in FIG. 6A. In some embodiments, the flat strap 52 can include expanded metal lathes along either side with slots or holes 60, and an area in between for attachment of the intumescent material 50. In some embodiments, the holes 60 can be about ¼" wide and about 1½" wide. Other sizes are also possible.

With continued reference to FIG. 7A, the wall component 66 can allow air movement through the vent when the intumescent material 50 has not expanded. The air can move through holes 68 into the open space inside the vent and then out through slots or holes 60. In at least some embodiments the holes 68 can be about ⅛" in diameter. Other sizes and shapes are also possible. When the intumescent material expands, it can cover up either or both sets of holes 68, 60, in order to inhibit fire, heat, and smoke from moving through the vent.

With reference to FIG. 7B, in some embodiments the intumescent material can instead be placed on the lower portion of the vent itself as opposed to the bottom of the flat strap 52. Holes 68 can be located on one or both sides of the intumescent material along the bottom of the vent, and slots or holes 60 can be located along the flat strap 52. Just as with the embodiment shown in FIG. 7A, the intumescent material 50 can expand to cover up holes 60 and/or 68 when exposed to elevated levels of heat, inhibiting fire, heat, and smoke from moving through the vent. In at least some embodiments the top of the vent can have at least one end that wraps about the flat strap 52 to help hold it in place, as shown in FIG. 7B.

In yet other embodiments, the intumescent material, or other fire-retardant material, can be sprayed or painted onto one or both sides of the bottom of the vent or onto the flat strap. The spray or paint can cover areas which surround the holes 68. When exposed to heat, the fire-retardant material can expand to cover the holes 68, thereby inhibiting fire, heat, and smoke from moving through the vent.

Figure 8:
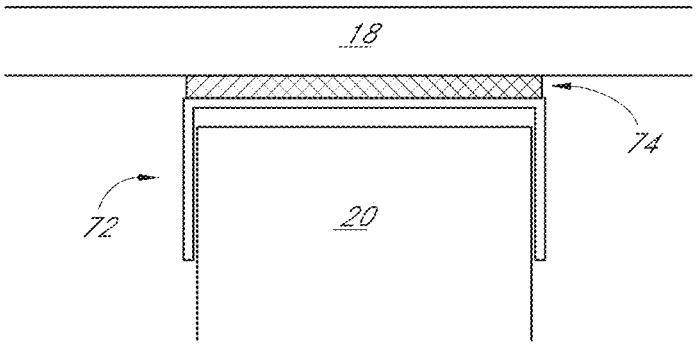
FIG. 8 illustrates a cross-sectional view of an embodiment of a fire-rated wall component with intumescent material on its top surface.

FIG. 8 illustrates another embodiment of a fire-rated wall component 72. In this embodiment, the wall component 72 is a track for holding a wall stud 20 beneath a ceiling 18. Here, the intumescent material 74 is attached to the top surface of the wall component 72. During installation, it is possible to install the wall component 72 and intumescent material 74 to the ceiling 18. In some embodiments, this may be accomplished by threading a screw through both the wall component and intumescent material. Additionally, in some embodiments the intumescent material may extend down one or both sides of the wall component 72.

Figure 9:
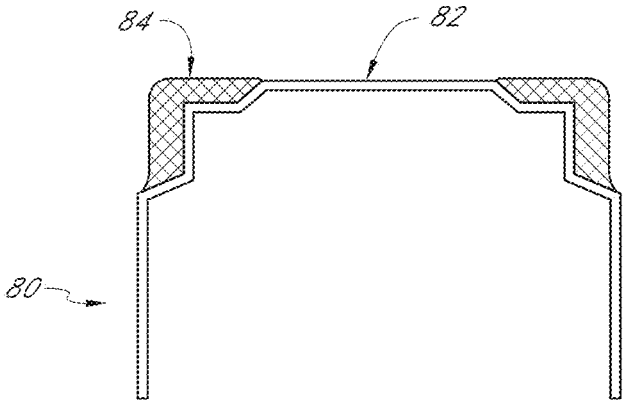
FIG. 9 illustrates a cross-sectional view of an embodiment of a fire-rated wall component with intumescent material on both its top and side surfaces.

FIG. 9 illustrates another embodiment of a fire-rated wall component 80. In this embodiment, the wall component 80 is a track for holding a wall stud. However, here the intumescent material 84 extends both along a portion of the top and side surfaces of the wall component 80. In particular, intumescent material is provided on the side and top surfaces of each corner portion of the wall component 80. In some embodiments, an outer surface of the intumescent material 84 may be flush with the top surface 82. In other embodiments, the intumescent material 84 may extend above the adjacent surfaces of the wall component 80, or may be positioned below the adjacent surfaces of the wall component 80.

Figure 10A:
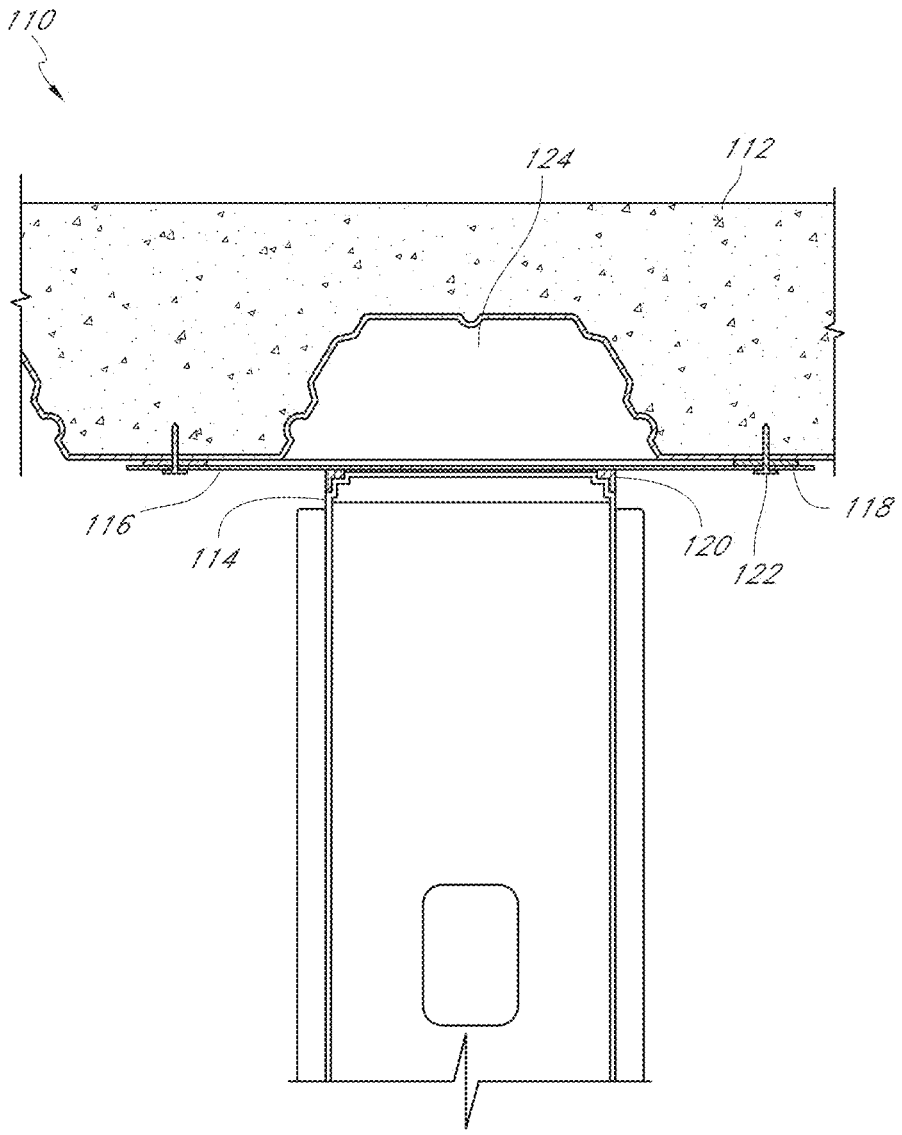
FIG. 10A illustrates a cross-sectional view of an embodiment of a wall system with a flat strap.

With reference to FIG. 10A, a fire-retardant wall system 110 can comprise a first wall component 112, a second wall component 114, a flat strap 116, and at least one strip of fire-retardant material 118. In at least some embodiments the first wall component 112 can comprise a fluted deck such as the one illustrated in FIG. 10A. In yet other embodiments the first wall component 112 can comprise a floor, ceiling, overhang, or any other type of wall component.

In at least some embodiments the second wall component 114 can comprise a track, or header track, such as the one illustrated in FIG. 10A, for retaining wall studs. The header track can comprise a slotted header track. In yet other embodiments the second wall component can comprise a different type of track or wall component.

Figure 10B:
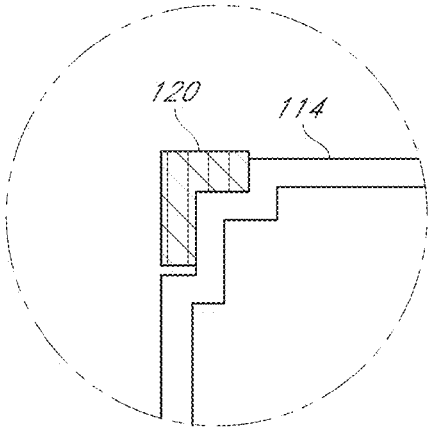
FIG. 10B illustrates a cross-sectional view of the track portion of the embodiment of FIG. 10A prior to installation.

With reference to FIGS. 10A and 10B, the second wall component 114 can include at least one gasket 120. The gasket 120 can itself comprise a strip of fire-retardant material, including but not limited to intumescent material. In at least some embodiments, the gasket 120 can be adhered to a surface of the second wall component 114 such that when the second wall component is attached to, pressed, and/or placed against the fire strap 116, the gasket or gaskets 120 can form a sound and/or air seal, inhibiting sound and/or air from moving from one side of the second wall component 114 to the other. For example, and with reference to FIG. 10B, in at least some embodiments the gasket can be adhered to the second wall component 114 such that a portion of it protrudes and/or extends past an adjacent edge of the second wall component 114. When the second wall component 114 is pressed against and/or attached to the flat strap 116 or other wall component, the portion of the gasket protruding past the edge can be compressed down towards the adjacent edge of the wall component 114 in order to form a seal between the flat strap 116 and second wall component 114. As described above, this seal and contact can inhibit air and sound from moving past the second wall component 114.

The flat strap 116 can be attached to the first wall component, the second wall component, or both the first and second wall components. For example, and as illustrated in FIG. 10A, the flat strap 116 can be attached via fasteners 122 to the first wall component 112. In at least some embodiments, the flat strap 116 can comprise an about 6"-8" wide 20 gauge flat strap. The flat strap 116 can be used to cover a portion or all of one or more flutes 124 of the fluted deck 112, FIG. 10A showing a cross-section of the flute 124. Thus, the flat strap 116 provides a surface for the second wall component 114 to contact when the wall component 114 is generally aligned with the length of the flute 124, or when the wall component 114 extends generally alongside and underneath the length of the flute 124 as shown in FIG. 10A. In other embodiments a portion or portions of the wall component 114 can be aligned with a portion of the fluted deck that does not include the flute 124.

With reference to FIGS. 10A-10D, the strip of fire-retardant material 118 can comprise intumescent material, which expands when subjected to elevated levels of heat, or can comprise other types of fire retardant material. In some embodiments an about ½" thick strip of material can be used. Other thicknesses are also possible.

Figure 10C:
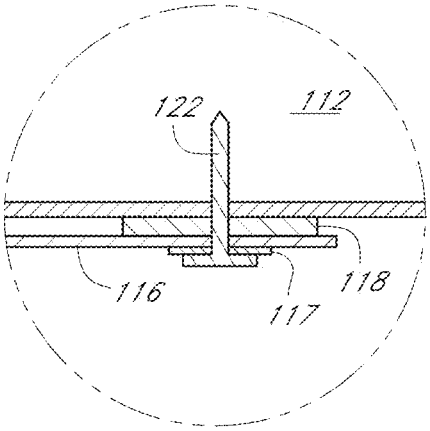
FIG. 10C illustrates a cross-sectional view of a portion of the embodiment of FIG. 10A.
Figure 10D:
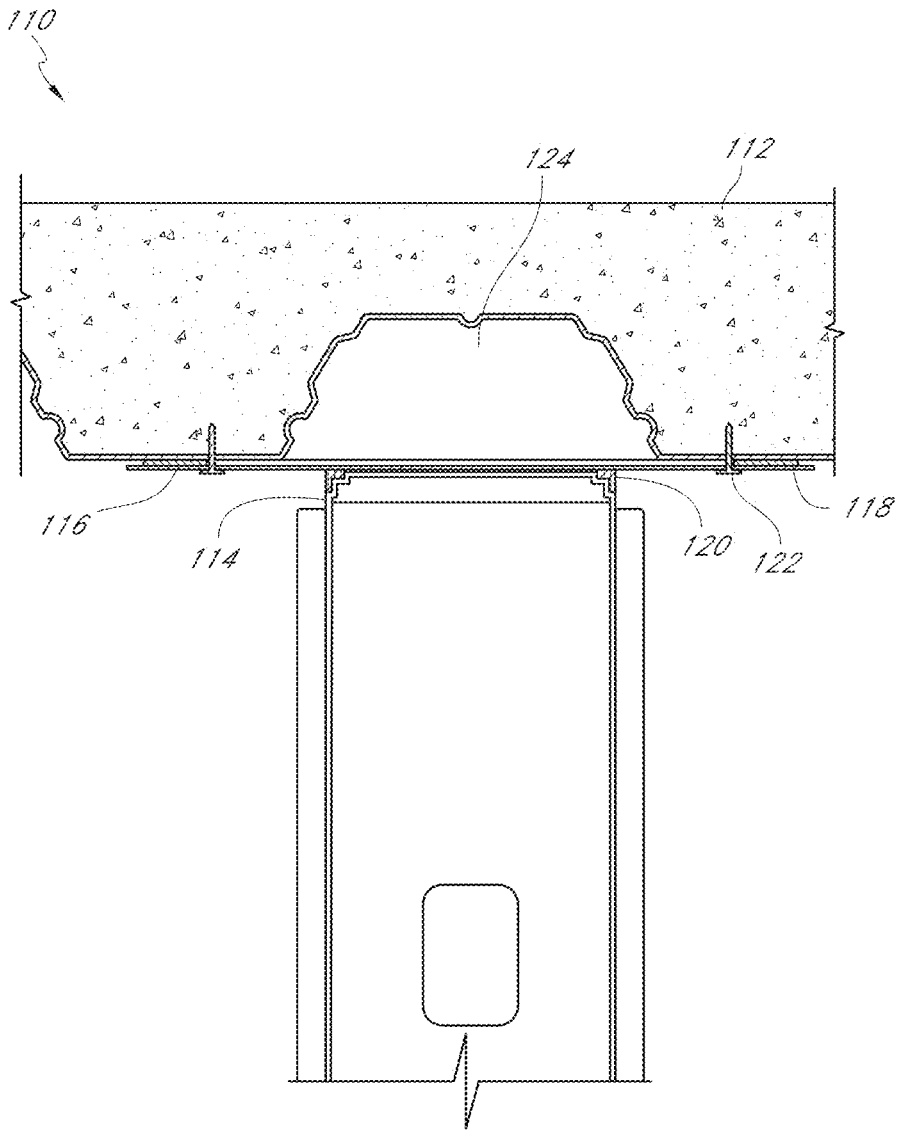

In at least some embodiments, and with reference to FIG. 10C, the strip of fire-retardant material 118 can be adhered to the flat strap so that it rests between the flat strap 116 and first wall component 112. In at least some embodiments, the fire-retardant system 110 can include two or more strips of fire-retardant material 118. In some embodiments, the strips of fire-retardant material 118 can be located approximately ¼" in from the ends of the flat strap 116. For example, and with reference to FIG. 10A, the system 110 can include one strip of fire-retardant material 118 located on each side of the second wall component 114 and on each side of the flute 124.

In at least some embodiments, and with reference to FIGS. 10A and 10C, the strip of fire-retardant material 118 can include a preformed fastener hole for insertion of the fastener 122. The fastener 122 can be fastened through the fire-retardant material 118. A washer 117 can be used between a head of the fastener 122 and the flat strap 116 to help secure the flat strap 116. The fastener 122 can help to secure the fire-retardant material in place. In other embodiments, and with reference to FIG. 10D, the fastener 122 can be located adjacent or inside of the fire-retardant material 118 along the flat strap 116.

In some embodiments, the fasteners 122 can be located every 12" on center along the length of the flat strap. In order to locate the areas for attachment, in at least some embodiments, the flat strap 116 can include the preformed fastener hole, as described above, or other suitable markings. For example, in some embodiments the flat strap can be indented, scored, or a laser or inkjet (or other suitable) line can be placed along the length of the flat strap 116, to help locate where the fasteners 122 should be installed through the fire-retardant material and into the wall component 112.

With continued reference to FIGS. 10A-10D, the fire-retardant system 110 can inhibit fire, smoke, air, sound, and/or debris from moving from one side of the second wall component 114 to the other (e.g. from one room to another inside a building). The strip or strips of fire-retardant material 118 and/or 120 can act as gaskets, preventing air and/or sound from moving past the system 110. At the same time, when the strips 118 and/or 120 are exposed to elevated levels of heat, they can expand and fill any gaps left between the flat strap 116 and first and second wall components 112, 114.

The flat strap 116 with fire-retardant material 118 can be used with other systems, decks, tracks, or wall components as well. Thus, it is not limited to use with a fluted wall component and/or header track, as illustrated in FIGS. 10A-10D.

Figure 11:
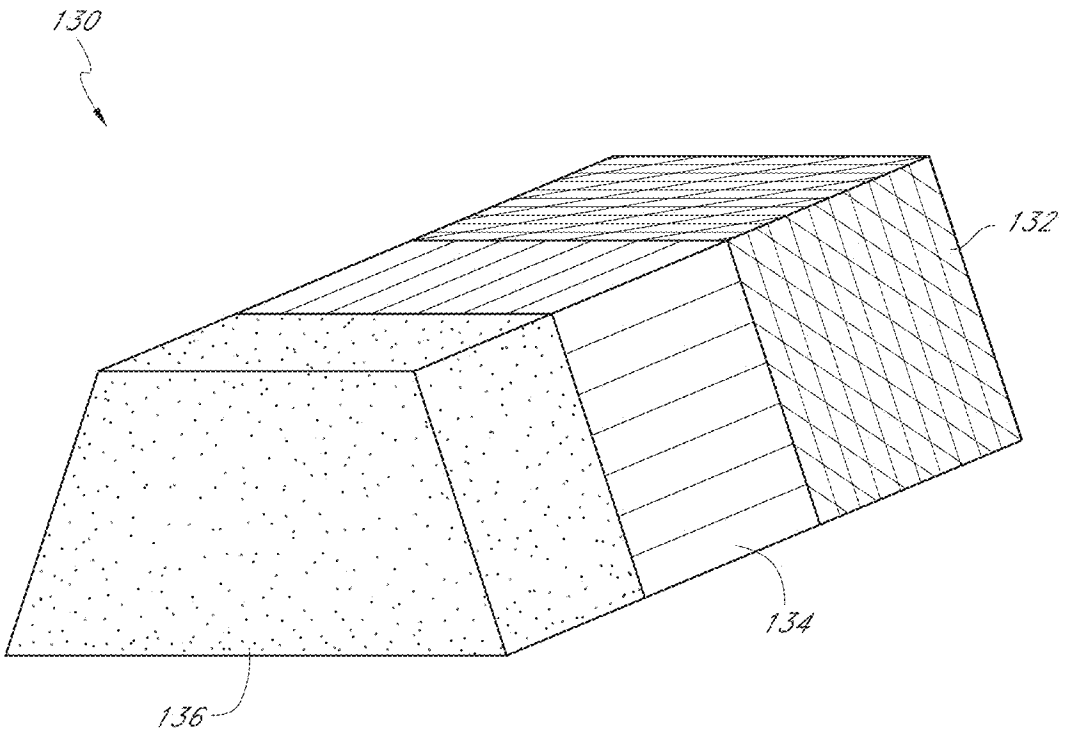
FIG. 11 illustrates a perspective view of an embodiment of a fire sponge.

With reference to FIGS. 11 and 12, a fire sponge 130 can be used to prevent the spread of fire, heat, and/or debris. The fire sponge 130 can be sized and shaped so that it is custom-made for particular sized and shaped spaces. For example, the fire sponge 130 can be shaped so that it fits snugly into the hollow area or areas of a fluted deck.

With continued reference to FIG. 11, the fire sponge 130 can comprise an inner layer of material 132, such as for example mineral wool. The inner layer 132 can be compressible, so that the entire sponge 130 can be compressed into an area smaller than the volume of the fire sponge 130 itself. The fire sponge 130 can further comprise another layer of material 134 outside of the inner layer 132. In some arrangements, the layer of material 134 can be the outermost layer, and in other arrangements can be an intermediate layer. In at least some embodiments the layer of material 132 can comprise fire-retardant material, including but not limited to intumescent material. In at least some embodiments, the fire sponge 130 can further comprise an additional outer layer of material 136, including but not limited to latex smoke seal. In one preferred embodiment, the outer layer of latex smoke seal can range between 1/16"-⅛" in thickness. This outer layer of latex smoke seal can give the fire sponge 130 a flexible, yet durable shape. For example, the latex can prevent wear and tear during shipping and/or installation, and can also prevent smoke from moving through the fire sponge 130.

Figure 12A:
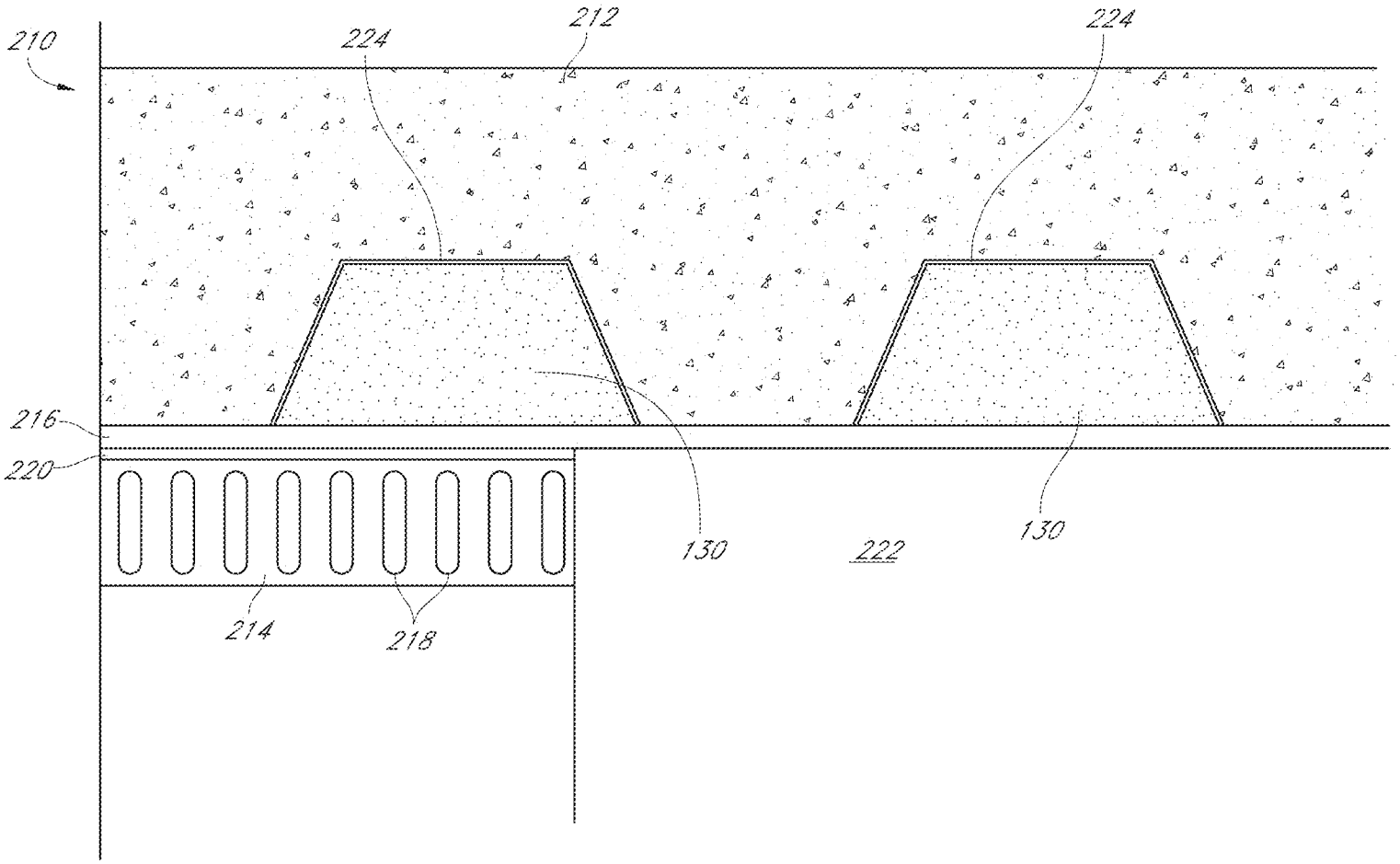
FIG. 12A illustrates a cross-sectional view of an embodiment of a wall system which incorporates the fire sponge of FIG. 11.

With reference to FIGS. 11 and 12A, the custom-made and pre-shaped fire sponges 130 can be made to have a trapezoidal cross-section so as to fit into the generally trapezoidal-shaped flutes commonly found in decks. In at least some embodiments, the trapezoidal-shaped fire sponge 130 can have widths which are larger than the widths of the flute. Other shapes and geometries are also possible. In some embodiments, the fire sponge 130 can be made at least in part of a compressible material, and its initial manufactured size can be larger than that of the flute 124. This allows the sponge 130 to be compressed to fit inside the flute 124, and once inside to expand and hold itself in place. For example, in at least one embodiment, the fire sponge 130 can be made to compress by approximately 30% of its initial volume to fit inside the flute 124. Other percentages and/or ranges of percentages are also possible.

Custom-made and pre-shaped fire sponges can reduce the amount of time required for fire-proofing the interior of a building, particularly if the size of the fluted wall components is known. For example, instead of placing or stuffing numerous, similar-shaped fire blocks or material into a hollow area and then using an airless sprayer to spray latex smoke sealer, a single custom-shaped fire sponge as described above can be used.

With continued reference to FIG. 12A, a fire-retardant wall system 210 can include a first fluted wall component 212 and a second, attached wall component 214. In at least some embodiments the first fluted wall component 212 can comprise a fluted deck, and can include hollow areas for insertion of a fire sponge or sponges 130. In at least some embodiments, the sponges 130 can be inserted after the second wall component 214 has been attached to the fluted wall component 212.

Figure 12B:
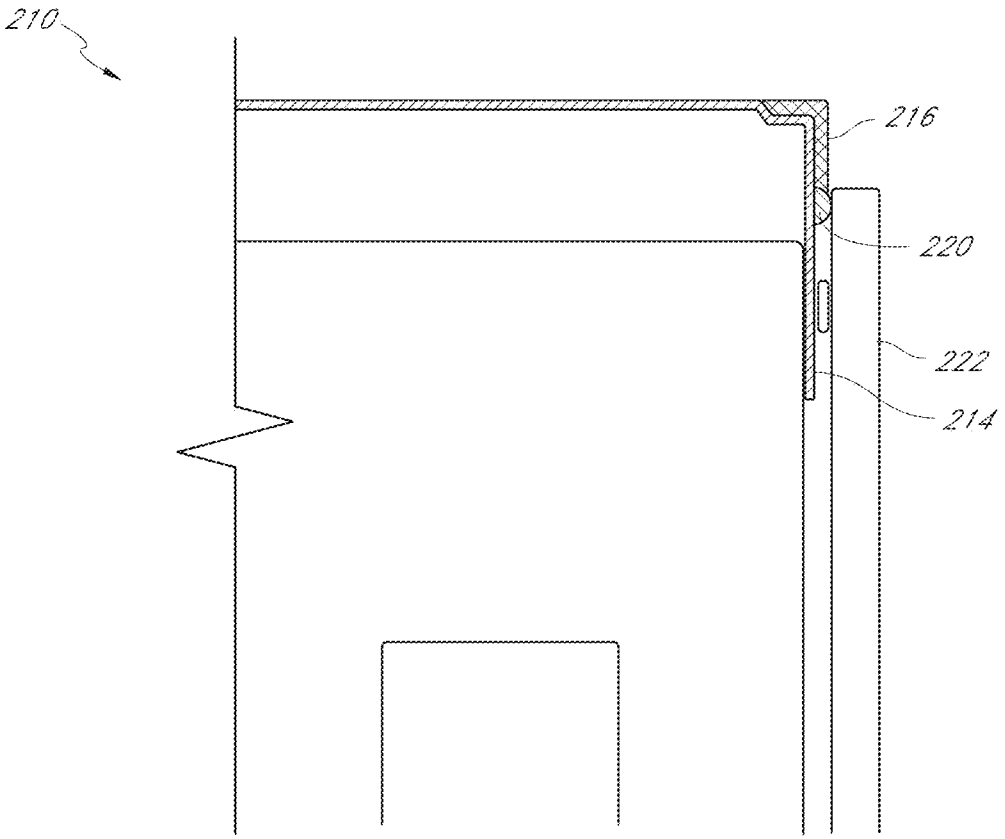
FIG. 12B illustrates a cross-sectional view of a portion of the embodiment of the wall system of FIG. 12A.

With reference to FIGS. 12A and 12B, in at least some embodiments the second wall component 214 can comprise a header track, which may be slotted or unslotted. In some embodiments the track can have a U-shape. In other embodiments it can have a J-shape. Other shapes are also possible. In at least some embodiments the track can be used for shaft areas in buildings, including but not limited to elevator shafts. In such arrangements, the structures for sealing with wallboard members described below may be provided on only one side of the track because the shaft side typically does not include wallboard.

With continued reference to FIGS. 12A and 12B, the illustrated header track is slotted and can comprise a strip or strips of fire-retardant material 216, including but not limited to intumescent material, along at least one flange. The strip of fire-retardant material 216 can be located along an area of the flange adjacent and/or proximal to the series of slots 218 in the flange. As illustrated in FIG. 12A, the second wall component 214 can extend along the bottom of the fluted wall component 212, generally perpendicular to the lengths of the flutes 224.

The second wall component 214 can further comprise a strip or strips of a sealing element 220 located between the strip 216 and series of slots 218, and also between the strip 216 and a piece or pieces of an outer wallboard member, such as a sheet of drywall 222, or other exterior material. The sealing element 220 can be a separate component from the track 214 such as, for example, caulk, foam or tape, and can be used to prevent or inhibit air from moving between the drywall and the second wall component 214. Alternatively, as described below, the sealing element can be formed by the track itself. For example, and with reference to FIG. 12B, the sealing element 220 can extend away from the flange and towards the drywall 222 such that the drywall 222 is able to rest against a portion of the sealing element 220. This configuration can help prevent air from moving between the drywall 222 and the track, while at the same time preventing the drywall from covering up or moving over and interfering with the fire-retardant material 216.

Figure 13:
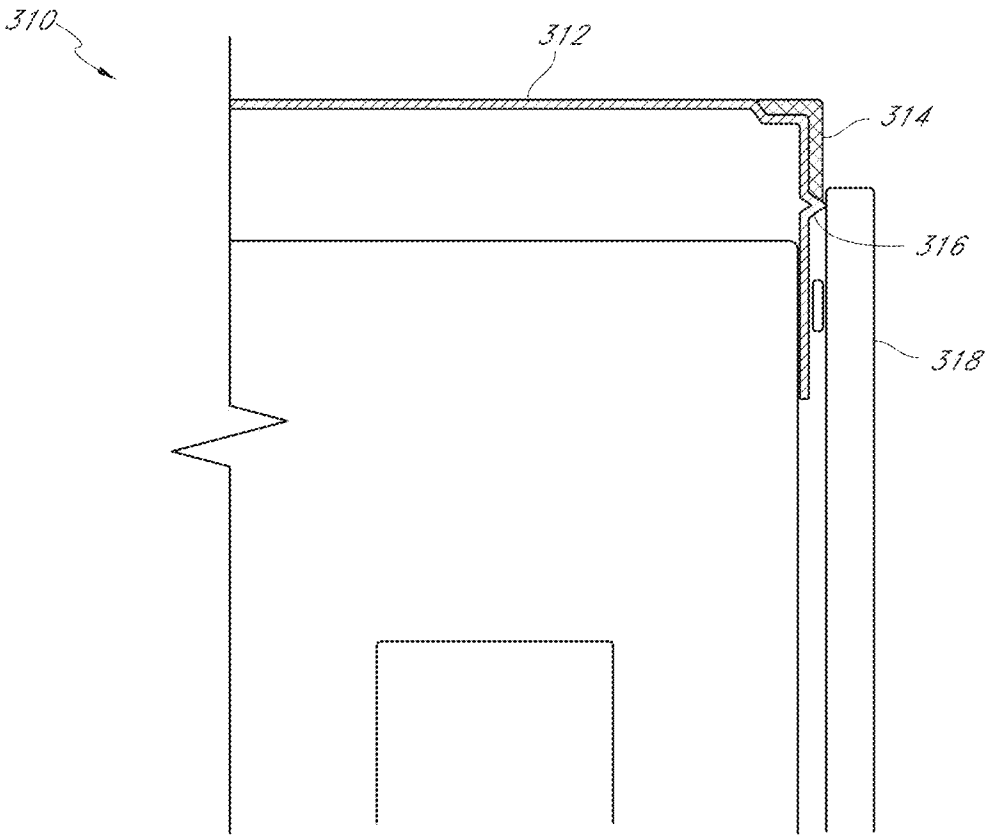
FIG. 13 illustrates a cross-sectional view of an embodiment of a wall system with a protruding groove to inhibit movement of air.

With reference to FIG. 13, other structures or embodiments for preventing unwanted airflow are also possible. For example, a fire-retardant wall system 310 can comprise a slotted or unslotted track 312. In the illustrated arrangement, the track 312 is slotted. The slotted track 312 can comprise at least one surface for accepting fire-retardant material 314 thereon. The at least one surface can be configured such that when the track is attached to a first wall component, the fire-retardant material 314 can expand and seal a gap between the slotted track 312 and first wall component when the fire-retardant material is exposed to elevated heat. The track 312 can also comprise an elongate protrusion or rib 316 located along at least a portion of one or more of the flanges of the track and proximal the at least one surface, as illustrated in FIG. 13.

In at least some embodiments, the elongate protrusion 316 can have a generally v-shaped cross section. Other cross-section shapes are also possible, for example, the protrusion 316 can be generally u-shaped or trapezoidal in shape. The elongate protrusion 316 can act as both a boundary area for the fire-retardant material, as well as a resting and/or attachment location for a piece of drywall 318, or other exterior material. The drywall can rest and/or remain in contact with the elongate protrusion 316, thereby blocking air from moving between the drywall 318 and slotted track 312. At the same time, the elongate protrusion 316 can help prevent the drywall 318 from contacting and/or interfering with the fire-retardant material 314.

In some embodiments, the drywall is fastened to a stud within the slotted track 312. The head portion 320 of the fastener can tend to bow out the drywall, leaving a gap at the top of the drywall to allow air, sound, or debris in general to move between the drywall and the slotted track 312. The sealing element 220 and/or elongate protrusion 316 can have depths large enough such that even if the drywall is bowed out, the drywall remains in contact with the sealing element 220 and/or elongate protrusion 316. For example, in some embodiments, the sealing element 220 and/or protrusion 316 can have depths at least equivalent to the depth of the fastener head 320. As described above, the track can be configured for use in a shaft wall application. In such an arrangement, the track may include fire-retardant material 216 or 314 and the sealing element 220 or protrusion 316 on only one side (i.e., the side opposite the shaft). The flange of the track facing the shaft may be the same or a different length (shorter or longer) than the opposite flange. In some applications, it may be desirable for the shaft flange to be longer than the opposite flange.

The present application does not seek to limit itself to only those embodiments discussed above. Other embodiments resembling tracks, vents, or other wall components are possible as well. Various geometries and designs may be used in the wall components to accommodate the use of fire-retardant material. Additionally, various materials may be used. In at least some embodiments the wall component and wall system materials can comprise steel, iron, or other material having at least some structural capacity. The fire-retardant materials can comprise intumescent material, such as for example BlazeSeal™, or some other material which accomplishes the same purposes as those described above.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A pre-shaped fire proofing plug to fill a flute of an overhead structure above a wall, the pre-shaped fire proofing plug comprising:

a first layer, the first layer comprising compressible material configured to fill a generally trapezoidal space of the overhead structure above the wall;

a second layer that covers all sides of the first layer;

wherein the first layer and the second layer form an integrated component having a trapezoidal cross-section as manufactured prior to installation within the space of the overhead structure;

wherein prior to installation, the cross-section of the pre-shaped fire proofing plug as manufactured is larger than the cross-section of the space of the overhead structure;

wherein after the installation, the pre-shaped fire proofing plug is compressed relative to the cross-section as manufactured to fill the space of the overhead structure to block passage of smoke or fire.

2. The pre-shaped fire proofing plug of claim 1, wherein the compressible material is mineral wool.

3. The pre-shaped fire proofing plug of claim 1, wherein a volume of the pre-shaped fire proofing plug as manufactured is approximately 30% larger than a volume of the pre-shaped fire proofing plug after compression and installation within the space of the overhead structure prior to installation.

4. The pre-shaped fire proofing plug of claim 1, wherein the first layer is intumescent material.

5. The pre-shaped fire proofing plug of claim 1, wherein the second layer is latex smoke seal.

6. The pre-shaped fire proofing plug of claim 1, wherein a perimeter of the second layer is larger than the perimeter of the first layer.

7. The pre-shaped fire proofing plug of claim 1, further comprising a third layer between the first layer and the second layer.

8. The pre-shaped fire proofing plug of claim 1, wherein the overhead structure is a metal deck.

9. The pre-shaped fire proofing plug of claim 2, wherein the second layer comprises flexible material.

10. The pre-shaped fire proofing plug of claim 2, wherein at least a width of the pre-shaped fire proofing plug is reduced between an as manufactured size and an installed size.

* * * * *